US008294654B2

(12) United States Patent
Jang

(10) Patent No.: US 8,294,654 B2
(45) Date of Patent: Oct. 23, 2012

(54) DISPLAY DEVICE AND DRIVING METHOD THEREOF

(75) Inventor: Yong Ho Jang, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 13/340,158

(22) Filed: Dec. 29, 2011

(65) Prior Publication Data

US 2012/0098808 A1 Apr. 26, 2012

Related U.S. Application Data

(62) Division of application No. 11/728,934, filed on Mar. 27, 2007, now Pat. No. 8,102,350.

(30) Foreign Application Priority Data

Mar. 30, 2006 (KR) ..... P2006-0028979

(51) Int. Cl.
*G09G 3/36* (2006.01)

(52) U.S. Cl. ..... 345/96

(58) Field of Classification Search ..... 345/87–104
See application file for complete search history.

(56) References Cited

U.S. PATENT DOCUMENTS

| | | | | |
|---|---|---|---|---|
| 5,798,741 | A | 8/1998 | Kajihara | |
| 6,195,183 | B1 * | 2/2001 | Fujimoto et al. | 358/514 |
| 6,405,346 | B1 | 6/2002 | Nawa | |
| 2003/0001812 | A1 | 1/2003 | Lee et al. | |
| 2003/0234760 | A1 | 12/2003 | Lin et al. | |
| 2006/0284815 | A1 | 12/2006 | Kwon et al. | |

* cited by examiner

*Primary Examiner* — Sumati Lefkowitz
*Assistant Examiner* — Robert E Carter, III
(74) *Attorney, Agent, or Firm* — Brinks Hofer Gilson & Lione

(57) ABSTRACT

A display device and driving method are provided. A display device includes a display area that includes a plurality of pixel cells in respective pixel regions defined by a plurality of gate and data lines crossing each other. A data driver is operable to supply data signals to the pixel cells. The pixel cells are connected with the first data line and are divided into a plurality of pixel-cell groups. The data driver is operable to supply the data signal of first polarity to the pixel cells included in the odd-numbered pixel-cell groups, and to supply the data signal of second polarity to the pixel cells included in the even-numbered pixel-cell groups. The first polarity is opposite to the second polarity. A shift register that is operable to drive the gate lines to supply the scan pulses of different amplitudes to neighboring pixel cells included in the different pixel-cell groups.

49 Claims, 19 Drawing Sheets

DISPLAY DEVICE AND DRIVING METHOD THEREOF

The present patent document is a divisional of U.S. patent application Ser. No. 11/728,934, filed Mar. 27, 2007 now U.S. Pat. No. 8,102,350, which claims priority to Korean Patent Application No. P2006-0028979 filed in Korea on Mar. 30, 2006, which are hereby incorporated by reference.

BACKGROUND

1. Field of the Invention

The present embodiments relate to a display device, and a method of driving the same.

2. Discussion of the Related Art

Generally, a liquid crystal display (LCD) device displays images by controlling light transmittance of liquid crystal cells on the basis of video signals. Particularly, an active matrix LCD device (AM LCD device) is suitable for displaying moving images because the AM LCD device includes switching elements formed in pixel cells respectively. The switching elements are generally formed of thin film transistors (TFT). The LCD device includes a plurality of gate and data lines, wherein the gate line is formed in perpendicular to the data line.

FIG. 1 illustrates a waveform of a data signal supplied to a data line of an LCD device according to the related art. As shown in FIG. 1, if driving the data line by 2-dot driving mode, the data line is alternately charged with a data signal (Data) having a positive polarity and a data signal (Data) having a negative polarity by each period of 2H. The data line is charged with the data signal having the positive polarity during the two periods, and is then charged with the data signal having the negative polarity during the two following periods.

When observing the two adjacent periods, there are two cases. The first case has the data line charged with the data signals (Data) of the different polarities, and the second case has the data line charged with the data signals (Data) of the same polarity.

If the predetermined pixel cell is supplied with the corresponding data signal (Data) outputted from the data line at the second period, the data signal (Data) charged in the data line at the first period affects the predetermined pixel cell. If the polarity of data signal (Data) supplied to the data line at the first period is the same as the polarity of data signal (Data) supplied to the data line at the second period, the pixel cell displays the image of normal luminance. If the polarity of data signal (Data) supplied to the data line at the first period is opposite to the polarity of data signal (Data) supplied to the data line at the second period, the pixel cell displays the image of abnormal luminance, due to the deteriorated charging properties of pixel cell. Abnormal luminance is higher or lower than the normal luminance. Even though the pixel cell of displaying the same color is supplied with the data signals of the same gray scale, the luminance difference may be generated according to the charging conditions of the data line, whereby the picture quality is deteriorated.

BRIEF SUMMARY

The present embodiments directed to a display device and driving method thereof may obviate one or more problems due to limitations and disadvantages of the related art.

For example, in one embodiment, a display device can decrease a luminance difference between adjacent pixels by differently modulating pulse width and amplitude of scan pulses supplied to respective gate lines.

Additional advantages, objects, and features of the present embodiments will be set forth in part in the description which follows and in part will become apparent to those having ordinary skill in the art upon examination of the following or may be learned from practice of the embodiments. The objectives and other advantages may be realized and attained by the structure particularly pointed out in the written description and claims hereof as well as the appended drawings.

In one embodiment, a display device comprises a display area which includes a plurality of pixel cells in respective pixel regions defined by a plurality of gate and data lines crossing each other. A data driver supplies data signals to the pixel cells. The pixel cells connected with the first data line are divided into a plurality of pixel-cell groups. Each group is provided with at least two pixel cells. The data driver supplies the data signal of first polarity to the pixel cells included in the odd-numbered pixel-cell groups, and supplies the data signal of second polarity to the pixel cells included in the even-numbered pixel-cell groups. The first polarity is opposite to the second polarity. A shift register drives the gate lines to supply the scan pulses of different amplitudes to the neighboring pixel cells included in the different pixel-cell groups.

In one embodiment, a display device comprises a display area which includes a plurality of pixel cells in respective pixel regions defined by a plurality of gate and data lines crossing each other. A data driver supplies data signals to the pixel cells. The pixel cells connected with the first data line are divided into a plurality of pixel-cell groups, each group provided with at least two pixel cells. The data driver supplies the data signal of first polarity to the pixel cells of the odd-numbered pixel-cell groups, and supplies the data signal of second polarity to the pixel cells of the even-numbered pixel-cell groups. The first polarity is opposite to the second polarity. A shift register drives the gate lines such that the scan pulses provided with the different amplitudes and pulse widths are supplied to the neighboring pixel cells included in the different pixel-cell groups.

In one embodiment, at least one of first pixel cell which is supplied with a data signal of a first present period, on condition of that the data signal supplied to a data line at the first present period and the data signal supplied to a data line at a first previous period differ in polarity; at least one of second pixel cell which is supplied with a data signal of a second present period, on condition of that the data signal supplied to the data line at the second present period and the data signal supplied to a data line at a second previous period are same in polarity; and a shift register which drives gate lines connected with the first and second pixel cells such that scan pulses having the different amplitudes or pulse widths are selectively supplied to the gate lines connected with the first and second pixel cells.

In another embodiment, for a driving method of display device provided with a display area including a plurality of pixel cells in respective pixel regions defined by a plurality of gate and data lines crossing each other; and a data driver which supplies data signals to the pixel cells, wherein the pixel cells connected with the predetermined data line are divided into a plurality of pixel-cell groups, each group provided with at least two pixel cells, and the data driver supplies the data signal of first polarity to the pixel cells of the odd-numbered pixel-cell groups, and supplies the data signal of second polarity being opposite to the first polarity to the pixel cells of the even-numbered pixel-cell groups, the gate lines are driven such that the scan pulses of the different amplitudes are supplied to the neighboring pixel cells included in the different pixel-cell groups.

In another embodiment, A driving method for driving a display device that includes at least one first pixel cell that is supplied with a data signal of a first present period, on condition of that the data signal supplied to a data line at the first present period and the data signal supplied to a data line at a first previous period differ in polarity; and at least one second pixel cell that is supplied with a data signal of a second present period, on condition of that the data signal supplied to a data line at the second present period and the data signal supplied to a data line at a second previous period differ in polarity: supplying scan pulses having different amplitudes or pulse widths to the gate lines connected with the first and second pixel cells.

It is to be understood that both the foregoing general description and the following detailed description of the present embodiments are exemplary and explanatory and are intended to provide further explanation of the claimed subject matter.

DETAILED DESCRIPTION OF THE DRAWINGS AND THE PRESENTLY PREFERRED EMBODIMENTS

Reference will now be made in detail to the present embodiments, examples of which are illustrated in the accompanying drawings. Wherever possible, the same reference numbers will be used throughout the drawings to refer to the same or like parts.

Figure 1:
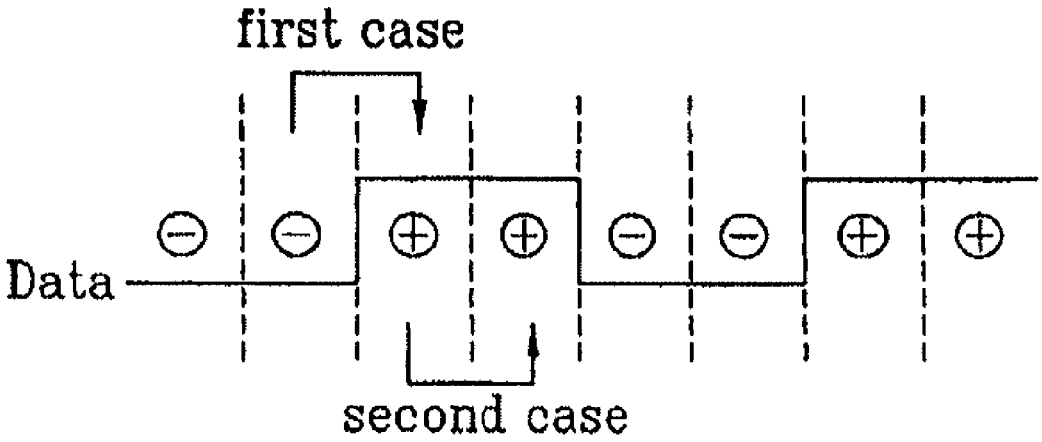
FIG. 1 Related Art
FIG. 1 is a view of illustrating a waveform of data signal supplied to a data line of an LCD device according to the related art.
Figure 2:
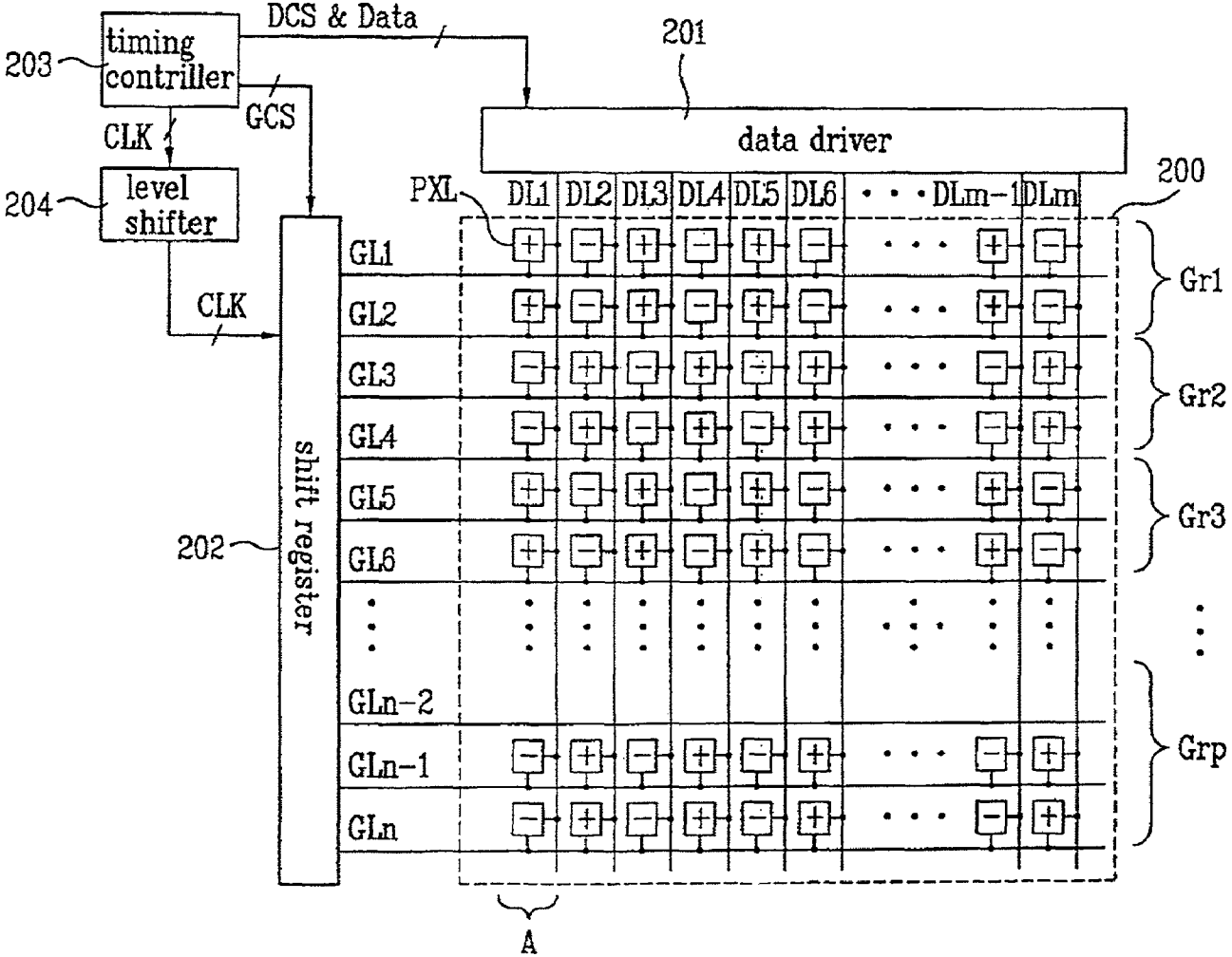
FIG. 2 is a view of illustrating a display device according to the first embodiment.
Figure 3:
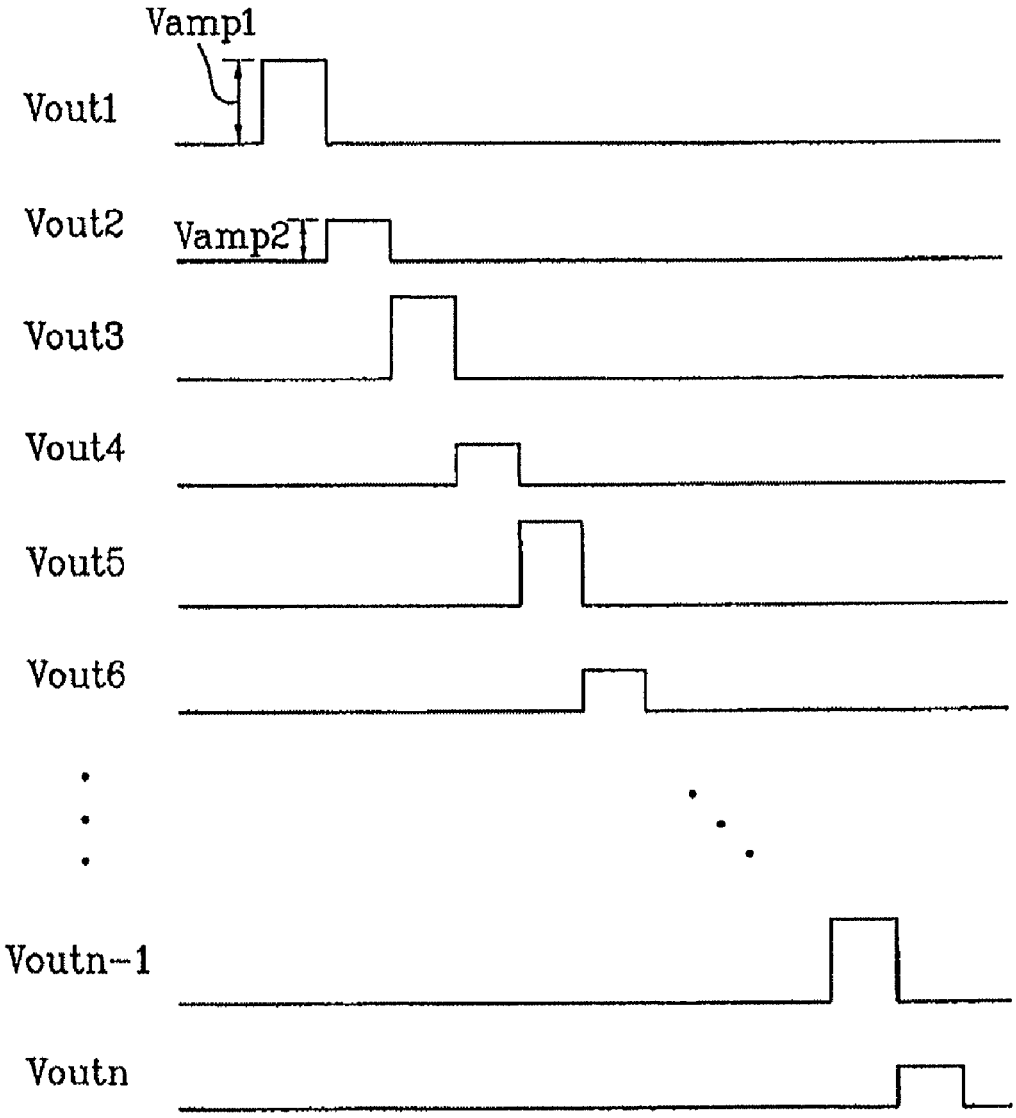
FIG. 3 is a timing view of scan pulses supplied to gate lines of FIG. 2.
Figure 4:
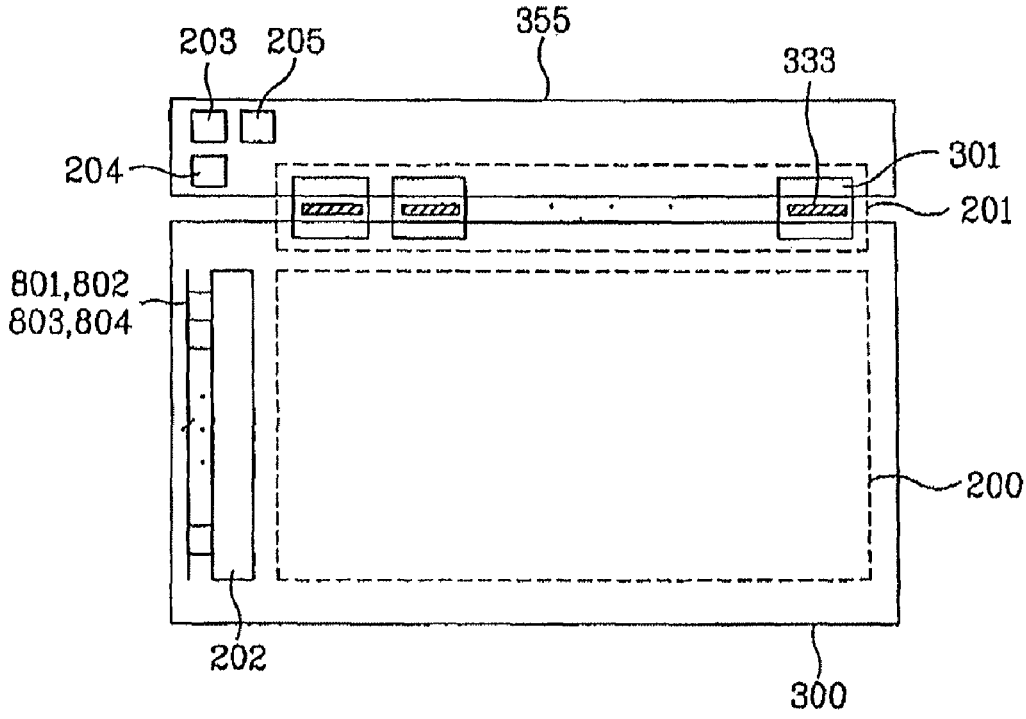
FIG. 4 is a view of illustrating an LCD panel and a printed circuit board provided with various elements of FIG. 2.

FIG. 2 is a view of illustrating a display device according to a first embodiment. FIG. 3 is a timing view of scan pulses supplied to gate lines of FIG. 2. FIG. 4 is a view of illustrating an LCD panel and a printed circuit board provided with various elements of FIG. 2.

In a first embodiment, as shown in FIG. 2, a display device includes a display area 200, a timing controller 203, a level shifter 204, a shift register 202, and a data driver 201. The display area 200 is provided with 'n' gate lines GL1 to GLn, 'm' data lines DL1 to DLm, and a plurality of pixel cells PXL in respective pixel regions defined by the gate and data lines crossing each other. The timing controller 203 outputs a plurality of clock pulses provided with the phase difference. The level shifter 204 changes the amplitude of clock pulses outputted from the timing controller 203, and outputs the clock pulses having the changed amplitude. The shift register 202 receives the clock pulses from the level shifter 204, outputs a plurality of scan pulses Vout1 to Voutn, and supplies the scan pulses Vout1 to Voutn to the gate lines GL1 to GLn in sequence. The data driver 201 drives the data lines DL1 to DLm.

In the first embodiment, as shown in FIG. 4, the display device includes a power supplier 205 which supplies various powers to the timing controller 203, the level shifter 204, the shift register 202, and the data driver 201.

The timing controller 203 generates a data control signal DCS and a gate control signal GCS using a main clock MCLK, a data enable signal DE, and horizontally and vertically synchronized signals Hsync and Vsync inputted through a user connector (not shown) from the external. The timing controller 203 controls the driving timing of the shift register 202 and data driver 201.

The data driver 201 converts a digital data signal Data, arranged in the timing controller 203 on the basis of the data control signal DCS supplied from the timing controller 203, into an analog data signal. The data driver 201 supplies the analog data signal for one horizontal line to the data lines DL1 to DLm by each horizontal period of supplying the scan pulse Vout1 to Voutn to the gate line GL1 to GLn.

In one embodiment, the data driver 201 divides the pixel cells PXL connected with the odd-numbered data line DL1, DL3, . . . , DLm-1 into a plurality of pixel-cell groups Gr1 to GRp, wherein each pixel-cell group is provided with the two pixel cells PXL. Through the odd-numbered data line DL1, DL3, . . . , DLm-1, the data signal of the positive polarity is supplied to the pixel cells PXL included in the odd-numbered pixel-cell groups Gr1, Gr3, . . . , Grp-1. The data signal of the negative polarity is supplied to the pixel cells PXL included in the even-numbered pixel-cell groups Gr2, Gr4, . . . , Grp.

In one embodiment, the data driver 201 divides the pixel cells PXL connected with the even-numbered data line DL2, DL4, . . . , DLm into a plurality of pixel-cell groups Gr1 to GRp, wherein each pixel-cell group is provided with the two pixel cells PXL. Through the even-numbered data line DL2, DL4, . . . , DLm, the data signal of the negative polarity is supplied to the pixel cells PXL included in the odd-numbered pixel-cell groups Gr1, Gr3, . . . , Grp-1. The data signal of the positive polarity is supplied to the pixel cells PXL included in the even-numbered pixel-cell groups Gr2, Gr4, . . . , Grp.

For example, the data signal of the positive polarity is supplied to the pixel cells PXL connected with the odd-numbered data line DL1, DL3, . . . , DLm-1 and included in the odd-numbered pixel-cell group Gr1, Gr3, . . . , Grp-1. The data signal of the negative polarity is supplied to the pixel cells PXL connected with the odd-numbered data line DL1, DL3, . . . , DLm-1 and included in the even-numbered pixel-cell group Gr2, Gr4, . . . , Grp. The data signal of the negative polarity is supplied to the pixel cells PXL connected with the even-numbered data line DL2, DL4, . . . , DLm and included in the odd-numbered pixel-cell group Gr1, Gr3, . . . , Grp-1. The data signal of the positive polarity is supplied to the pixel cells PXL connected with the even-numbered data line DL2, DL4, . . . , DLm and included in the even-numbered pixel-cell group Gr2, Gr4, . . . , Grp.

The pixel cells PXL connected with one data line in common are supplied with the data signals of the different polarities by each pixel-cell group. For example, the two pixel cells PXL connected with the first data line DL1 and included in the first pixel-cell group Gr1 are supplied with the data signal of the positive polarity. The two pixel cells PXL connected with the first data line DL1 and included in the second pixel-cell group Gr2 are supplied with the data signal of the negative polarity. The data driver 201 changes the polarity of data signals supplied to the respective data lines DL1 to DLm by each frame. Accordingly, the pixel cells PXL of the odd-numbered frames have the polarity patterns as shown in FIG. 2. Not shown in the drawings, the pixel cells PXL of the odd-numbered frames have the polarity pattern opposite to the polarity patterns in the pixel cells PXL of the even-numbered frames. The data driver 201 drives the display device by 2-dot driving mode.

For the 2-dot driving mode, the pixel cells PXL connected with the odd-numbered gate lines GL1, GL3, . . . , GLn-1 and the pixel cells PXL connected with the even-numbered gate lines GL2, GL4, . . . , GLn are supplied with the data signals under the different charging conditions. On condition that the polarity of data signal supplied to the data line during the first period is different from the polarity of data signal supplied to the data line during the second period, the pixel cells PXL connected with the odd-numbered gate lines GL1, GL3, . . . , GLn-1 display images corresponding to the data signal supplied to the data line at the second period. For example, the pixel cells PXL connected with the odd-numbered gate lines GL1, GL3, . . . , GLn-1 are supplied with the corresponding data signal under the condition of first case mentioned in the related art. On condition that the polarity of data signal supplied to the data line during the first period is the same as the polarity of data signal supplied to the data line during the second period, the pixel cells PXL connected with the even-numbered gate lines GL2, GL4, . . . , GLn display images corresponding to the data signal supplied to the data line at the second period. The pixel cells PXL connected with the even-numbered gate lines GL2, GL4, . . . , GLn are supplied with the corresponding data signal under the condition of the second case mentioned in the related art.

The polarity of data signals supplied to the data lines DL1 to DLm is inverted every two periods. The data driver 201 simultaneously supplies the data signal to the data lines DL1 to DLm every period of driving the gate lines GL1 to GLn. The data signal of positive polarity and the data signal of negative polarity are alternately supplied to the data lines DL1 to DLm every two periods (two horizontal periods). For example, the data signal of positive polarity is supplied to one data line at two periods, and the data signal of negative polarity is supplied to the data line at two following periods. During the same period, the adjacent two of data lines are supplied with the different polarities of the data signal.

Each pixel cell PXL includes a switching element, a pixel electrode, a common electrode, and a liquid crystal layer. The switching element is turned-on based on the scan pulse from the gate line, to thereby switch the data signal outputted from the data line. The pixel electrode is supplied with the data signal from the switching element. The common electrode is provided in opposite to the pixel electrode. The liquid crystal layer is provided between the common electrode and the pixel electrode, so as to control a light transmittance based on an electric field generated between the common electrode and the pixel electrode. The common electrode is supplied with a common voltage of constant value. At this time, the data signal of positive polarity has a voltage level which is higher than the common voltage. The data signal of negative polarity has a voltage level which is lower than the common voltage.

As shown in FIG. 3, the shift register 202 outputs the two types of scan pulses. For example, the shift register 202 outputs the scan pulse Vout1, Vout3, . . . , Voutn-1 provided with a first amplitude Vamp1, and also outputs the scan pulse Vout2, Vout4, . . . , Voutn provided with a second amplitude Vamp2. The first amplitude Vamp1 is larger than the second amplitude Vamp2. The scan pulse provided with the first amplitude Vamp1 includes a first high-voltage source and a first low-voltage source. The scan pulse provided with the second amplitude Vamp2 includes a second high-voltage source and a second low-voltage source. The first high-voltage source is larger than the second high-voltage source. Each of the scan pulse Vout1, Vout3, . . . , Voutn-1 provided with the first amplitude Vamp1 and the scan pulse Vout2, Vout4, . . . , Voutn provided with the second amplitude Vamp 2 has such a size as to turn-on the switching element of the pixel cell PXL completely.

The shift register 202 drives the first to 'n'th gate lines GL1 to GLn in sequence. For the pixel cells PLX supplied with the data signals having the different polarities, the scan pulse of the second amplitude Vamp2 is supplied to the gate line connected with the firstly driven pixel cell, and the scan pulse of the first amplitude Vamp1 is supplied to the gate line connected with the secondly driven pixel cell.

As shown in FIG. 4, the data driver 201 is provided with a plurality of data drive integrated circuits ICs 333. Each of the data drive ICs 333 drives the plurality of data lines DL1 to DLm. The data drive ICs 333 are respectively mounted on tape carrier packages TCPs 301. The display area 200, the gate lines GL1 to GLn, the data lines DL1 to DLm, the shift register 202, and a plurality of clock transmission lines 801 to 804 are formed on an LCD panel 300. The plurality of clock transmission lines 801 and 804 transmit the clock pulses outputted from the level shifter 204 to the shifter register 202. At this time, the clock transmission lines 801 to 804 are electrically connected with output lines of the level shifter 204 by transmission lines formed in the leftmost TCP 301 among the plurality of TCPs 301.

The timing controller 203, the level shifter 204, and the power supplier 205 are mounted on a printed circuit board PCB 355. A flexible printed circuit FPC may be connected between the LCD panel 300 and the PCB 355. Through the FCP, the clock transmission lines 801 to 804 are electrically connected with the output lines of the level shifter 204.

An operation of the display device according to the present invention will be explained as follows. FIGS. 5A to 5D are timing views of the scan pulse, the data signal, and the common voltage supplied to the display area of FIG. 2. The pixel cells PXL of the display area 200 of FIG. 2 may be divided into a plurality of pixel-cell lines. For convenience of explanation, the pixel cells PXL provided in only one pixel-cell line A will be described as follows.

For the pixel cells PXL provided in the predetermined pixel-cell line A, that is, the pixel cells PXL connected with the first data line DL1, the uppermost one is defined as the first pixel cell, and the lowermost one is defined as the 'n'th pixel cell, in sequence. Also, the first to 'n'th pixel cells PXL are connected with the first data line DL1 in common, and are respectively connected with the first to 'n'th gate lines GL1 to GLn.

Figure 5A:
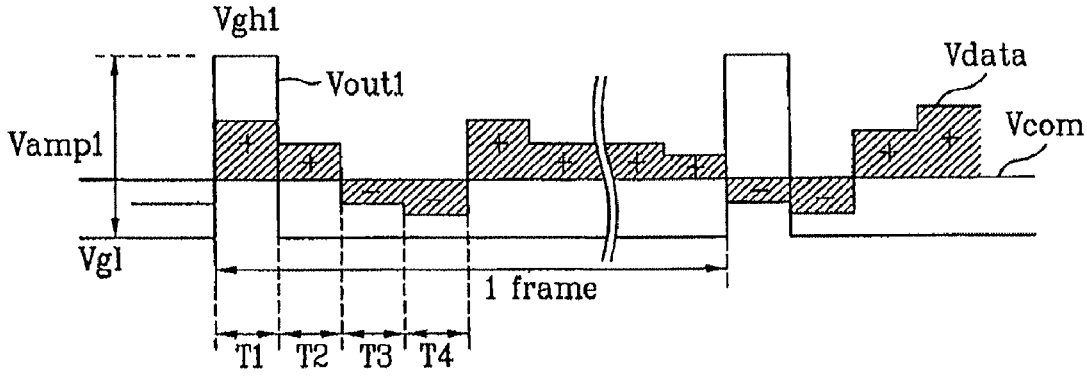
FIGS. 5A to 5D are timing views of a scan pulse, a data signal, and a common voltage supplied to a display area of FIG. 2.

During the first period T1, as shown in FIG. 5A, the shift register 202 supplies the first scan pulse Vout1 having the first amplitude Vamp1 to the first gate line GL1, thereby driving the first pixel cell PXL connected with the first gate line GL1. During the first period T1, the data driver 201 supplies the data signal of positive polarity to the first data line DL1. The first pixel cell PXL is supplied with the data signal of positive polarity charged in the first data line DL1. As explained above, the data signal of positive polarity has a voltage level which is higher than the common voltage Vcom. The data signal of negative polarity has a voltage level which is lower than the common voltage Vcom.

Figure 5B:
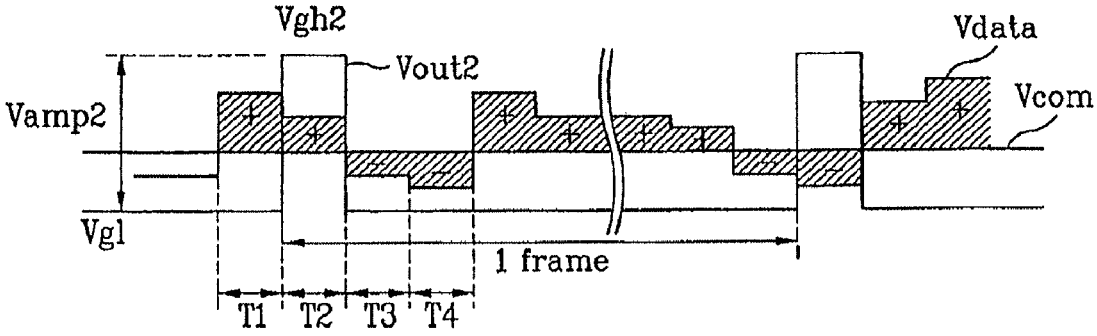

During the second period T2, as shown in FIG. 5B, the shift register 202 supplies the second scan pulse Vout2 having the second amplitude Vamp2 to the second gate line GL2, thereby driving the second pixel cell PXL connected with the second gate line GL2. During the second period T2, the data driver 201 supplies the data signal of positive polarity to the first data line DL1. Accordingly, the second pixel cell PXL is supplied with the data signal of positive polarity charged in the first data line DL1. For the successive first and second periods T1 and T2, the first data line DL1 is supplied with the data signal of the same polarity, that is, the data signal of positive polarity. Thus, the first data line DL1 is charged with a target voltage value at the second period T2. As a result, there is no luminance difference between the first and second pixel cells PXL.

Figure 5C:
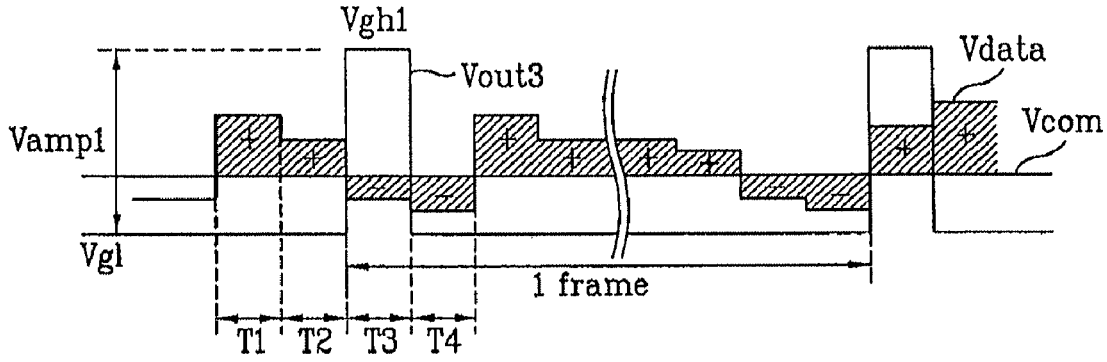

During the third period T3, as shown in FIG. 5C, the shift register 202 supplies the third scan pulse Vout3 having the first amplitude Vamp1 to the third gate line GL3, thereby driving the third pixel cell PXL connected with the third gate line GL3. During the third period T3, the data driver 201 supplies the data signal of negative polarity to the first data line DL1. The third pixel cell PXL is supplied with the data signal of negative polarity charged in the first data line DL1. Because the polarity of data signal charged in the first data line DL1 is inverted at the third period T3, it is difficult for the first data line DL1 to maintain the target voltage value in an effective period.

The amplitude of third scan pulse Vout3 supplied to the third gate line GL3 is larger than the amplitude of second scan pulse Vout2 supplied to the second gate line GL2, whereby the switching element supplied with the third scan pulse Vout3 (the switching element positioned in the third pixel cell PXL and connected with the third gate line GL3) is turned-on excessively. Accordingly, the data signal of negative polarity charged in the first data line DL1 is sufficiently supplied to the pixel electrode of the third pixel cell PXL within the effective period through the turned-on switching element. Accordingly, there is no luminance difference between the third and fourth pixel cells PXL.

Figure 5D:
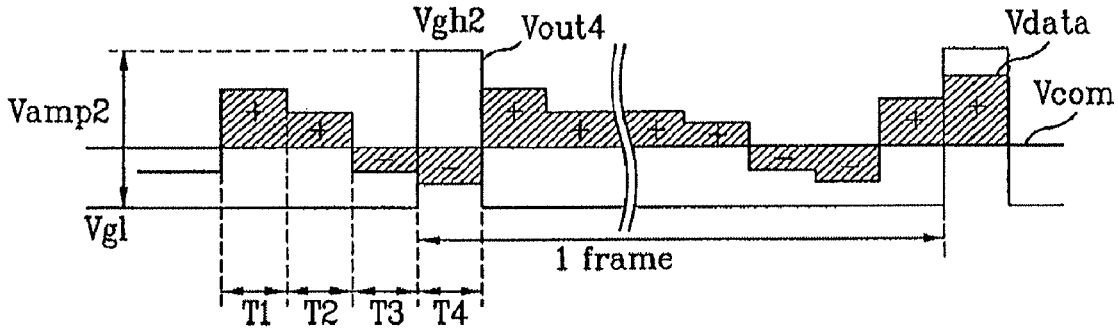

During the fourth period T4, as shown in FIG. 5D, the shift register 202 supplies the fourth scan pulse Vout4 having the second amplitude Vamp2 to the fourth gate line GL4, thereby driving the fourth pixel cell PXL connected with the fourth gate line GL4. During the fourth period T4, the data driver 201 supplies the data signal of negative polarity to the first data line DL1. Accordingly, the fourth pixel cell PXL is supplied with the data signal of negative polarity charged in the first data line DL1. For the successive third and fourth periods T3 and T4, the first data line DL1 is supplied with the data signals of the same polarity, that is, the data signal of negative polarity. Thus, the data line is sufficiently charged with the target voltage value. As a result, there is no luminance difference between the first and second pixel cells PXL. The other pixel cells of fifth to 'n'th pixel cells PXL are also driven in the above-mentioned method.

Figure 6:
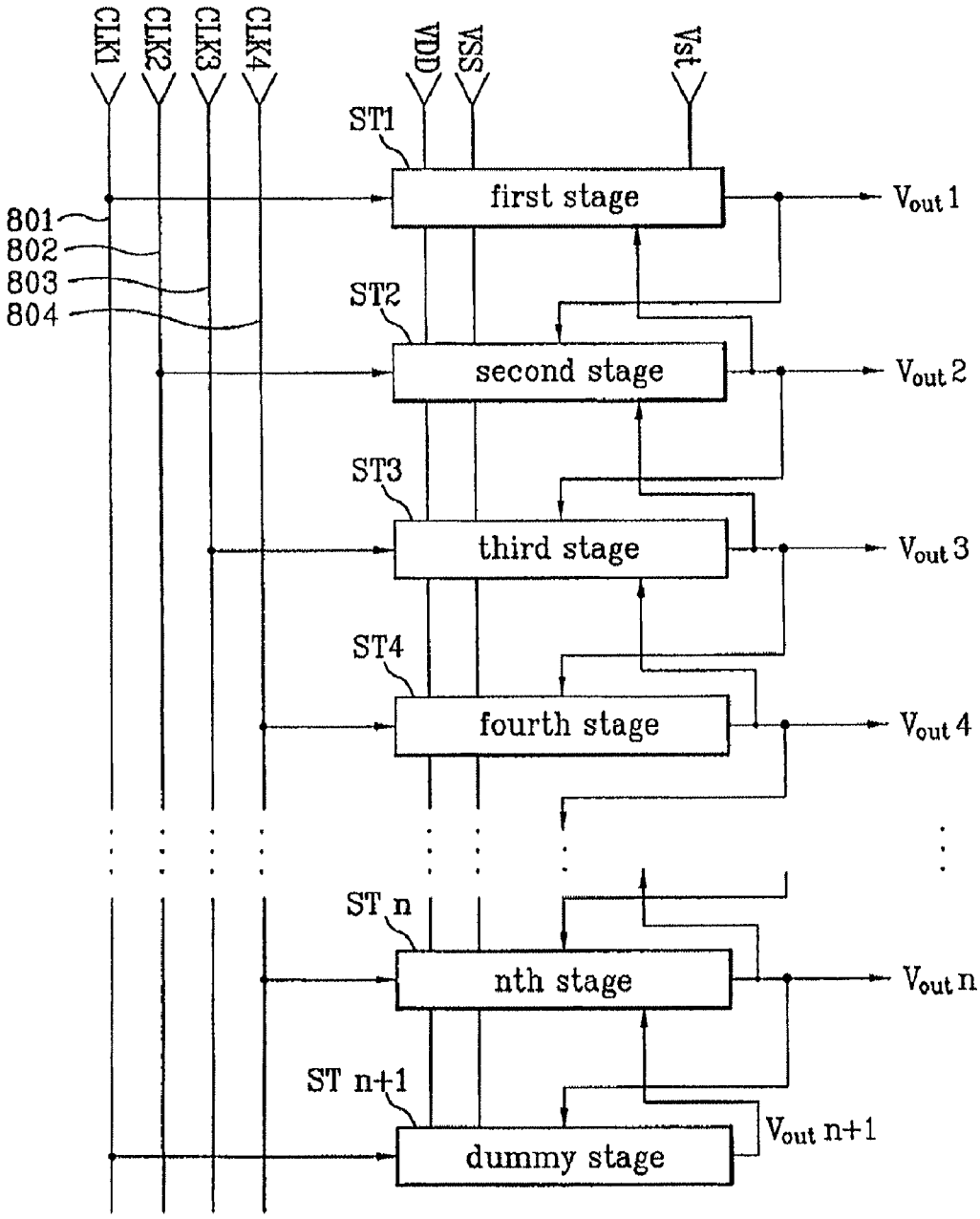
FIG. 6 is a detailed view of illustrating a shift register of FIG. 2.
Figure 7:
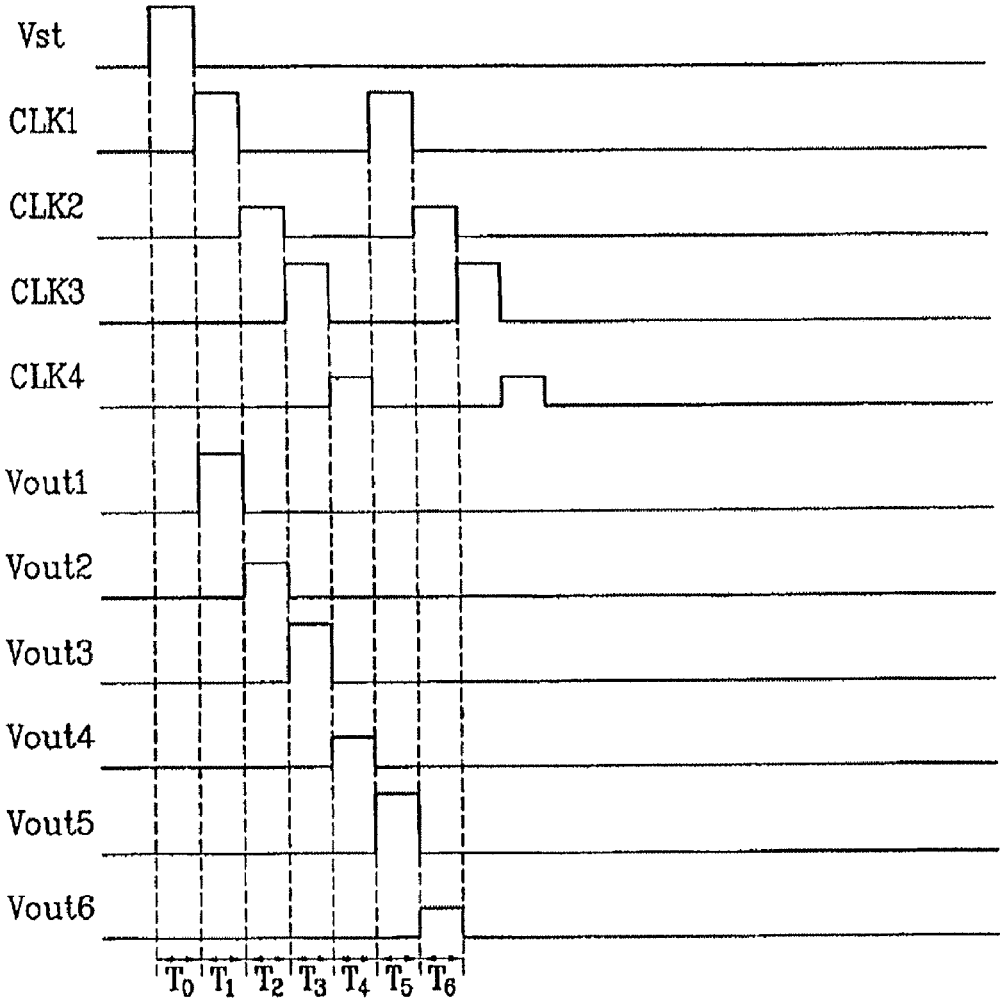
FIG. 7 is a timing view of various scan pulses supplied to the shift register of FIG. 6 and outputted from the shift register.

In order to output the above-mentioned scan pulses, the shift register 202 has the following structure. FIG. 6 illustrates the shift register of FIG. 2. FIG. 7 is a timing view of various scan pulses supplied to the shift register of FIG. 6 and scan pulses outputted from the shift register.

As shown in FIG. 6, the shift register 202 includes 'n' stages ST1 to STn and one dummy stage STn+1, wherein the 'n' stages ST1 to STn are subordinately connected with one another. The stages ST1 to STn+1 respectively outputs the scan pulses Vout1 to Voutn+1 by each frame. The scan pulses Vout1 to Voutn+1 are sequentially outputted from the first to dummy stages ST1 to STn+1, and are then sequentially supplied to the gate lines GL1 to GLn of the display area 200, thereby scanning the gate lines GL1 to GLn in sequence. Each of the stages ST1 to STn+1 of the shift register 202 is supplied with a first voltage source VDD, a second voltage source VSS, and any one of first to fourth clock pulses CLK1 to CLK4, wherein the first to fourth clock pulses CLK1 to CLK4 are provided with the sequence phase difference, as shown in FIG. 7.

The first to fourth clock pulses CLK1 to CLK4 are transmitted to the stages ST1 to STn+1 through the first to fourth clock transmission lines 801 to 804. The stages ST1 to STn+1 are connected in parallel, so that each of the stages ST1 to STn+1 is supplied with any one of the first to fourth clock pulses CLK1 to CLK4. Except the dummy stage STn+1, the '4q+1'th stage outputs the first clock pulse CLK1 as the scan pulse; the '4q+2'th stage outputs the second clock pulse CLK2 as the scan pulse. The '4q+3'th stage outputs the third clock pulse CLK3 as the scan pulse. The '4q+4'th stage outputs the fourth clock pulse CLK4 as the scan pulse ('q' is a positive integer inclusive of '0').

Each of the first and third clock pulses CLK1 and CLK3 has the first amplitude Vamp1, and each of the second and fourth clock pulses CLK2 and CLK4 has the second amplitude Vamp2. For example, the amplitude of first and third clock pulses CLK1 and CLK3 are larger than the amplitude of second and fourth clock pulses CLK2 and CLK4. The first voltage source VDD corresponds to a voltage source of positive polarity, and the second voltage source VSS corresponds to a voltage source of negative polarity. Among the plurality of stages ST1 to STn+1, the uppermost one of first stage ST1 is supplied with a start pulse Vst as well as the first voltage source VDD, the second voltage source VSS, and one clock pulse.

An operation of the above-mentioned shift register 202 will be explained as follows.

First, if the start pulse Vst is applied to the first stage ST1 at the starting time T0, the first stage ST1 is enabled in response to the start pulse Vst. As the first stage ST1 of the enabled state is supplied with the first clock pulse CLK1 outputted at the first period T1, the first stage ST1 outputs the first scan pulse Vout1. The first scan pulse Vout1 is supplied to the first gate line GL1 and the second stage ST2, whereby the second stage ST2 is enabled in response to the first scan pulse Vout1.

The second stage ST2 of the enabled state is supplied with the second clock pulse CLK2 outputted at the second period T2, so that the second stage ST2 outputs the second scan pulse Vout2. The second scan pulse Vout2 is supplied to the second gate line GL2, the third stage ST3, and the first stage ST1 together. The third stage ST3 is enabled in response to the second scan pulse Vout2. The first stage ST1 is disabled in response to the second scan pulse Vout2, whereby the second voltage source VSS is supplied to the first gate line GL1.

The third stage ST3 of the enabled state is supplied with the third clock pulse CLK3 outputted at the third period T3, so that the third stage ST3 outputs the third scan pulse Vout3. The third scan pulse Vout3 is supplied to the third gate line GL3, the fourth stage ST4, and the second stage ST2. The fourth stage ST4 is enabled in response to the third scan pulse Vout3. The second stage ST2 is disabled in response to the third scan pulse Vout3, whereby the second voltage source VSS is supplied to the second gate line GL2.

The fourth to 'n'th stages ST4 to STn respectively output the fourth to 'n'th scan pulses Vout3 to Voutn to the fourth to 'n'th gate lines GL4 to GLn in sequence. Eventually, the first to 'n'th gate lines GL1 to GLn are sequentially scanned based on the first to 'n'th scan pulses Vout1 to Voutn.

After the dummy stage STn+1 is enabled in response to the 'n'th scan pulse Voutn outputted from the 'n'th stage STn at the 'n'th period, the dummy stage STn+1 receives the first clock pulse CLK1 outputted at the 'n+1'th period, and outputs the 'n+1'th scan pulse Voutn+1. As the 'n+1'th scan pulse is supplied to the 'n'th stage STn, the 'n'th stage is disabled. The 'n'th stage STn being disabled at the 'n+1'th period supplies the second voltage source VSS to the 'n'th gate line GLn. For example, the dummy stage STn+1 supplies the 'n+1'th scan pulse Voutn+1 such that the 'n'th stage STn outputs the second voltage source VSS. However, the dummy stage STn+1 doesn't supply the 'n+1'th scan pulse Voutn+1 to the gate line.

Two or more dummy stages STn+1 may be provided based on the input/output relation between the stages.

In order to help the respective stages ST1 to STn+1 to output the scan pulses provided with the different amplitudes, the timing controller 203, the level shifter 204, and the power supplier 205 may be formed with the following structures.

Figure 8:
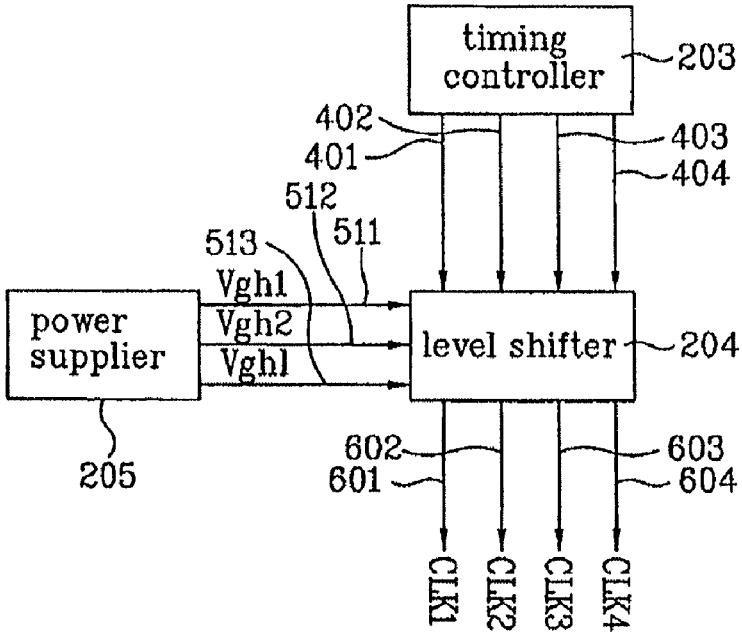
FIG. 8 is a view of illustrating a timing controller, a level shifter, and a power supplier, so as to control the amplitude of scan pulse, based on a first modified-structure.

FIG. 8 is a view of illustrating the timing controller, the level shifter and the power supplier, so as to control the amplitude of scan pulse, based on a first modified-structure. As shown in FIG. 8, the timing controller 203 outputs the plurality of clock pulses CLK1 to CLK4 provided with the phase difference. The level shifter 204 differently modulates the amplitude of clock pulses CLK1 to CLK4 outputted from the timing controller 203, and supplies the modulated ones to the shift register 202. The power supplier 205 supplies a first high-voltage source Vgh1, a second high-voltage source Vgh2, and a low-voltage source Vg1, which have the different values from one another, to the level shifter 204. The first to fourth clock pulses CLK1 to CLK4 outputted from the timing controller 203 have the same amplitude and the same pulse width. The first to fourth clock pulses CLK1 to CLK4 are supplied to the level shifter 204 through the first to fourth transmission lines 401 to 404.

The power supplier 205 supplies the first high-voltage source Vgh1, the second high-voltage source Vgh2, and the low-voltage source Vg1 to the level shifter 204 through first to third voltage-transmission lines 511 to 513. The level shifter 204 generates the first and third clock pulses CLK1 and CLK3 of the first amplitude Vamp1 using the first high-voltage source Vgh1 and the low-voltage source Vg1. The level shifter 204 generates the second and fourth clock pulses CLK2 and CLK4 of the second amplitude Vamp2 using the second high-voltage source Vgh2 and the low-voltage source Vg1.

The first to fourth clock pulses CLK1 to CLK4 having the modulated amplitude are supplied to the shift register 202 through first to fourth output lines 601 to 604. The first high-voltage source Vgh1 is larger than the second high-voltage source Vgh2, and the low-voltage source is smaller than the first high-voltage source Vgh1 and the second high-voltage source Vgh2.

The first amplitude Vamp1 corresponds to the differential voltage between the low-voltage source Vg1 and the first high-voltage source Vgh1, and the second amplitude Vamp2 corresponds to the differential voltage between the low-voltage source Vg1 and the second high-voltage source Vgh2.

Figure 9:
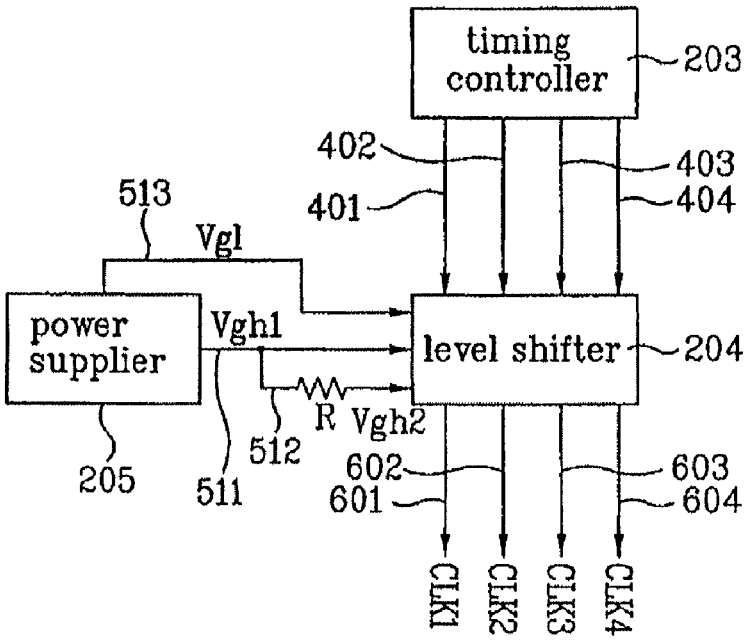
FIG. 9 is a view of illustrating a timing controller, a level shifter, and a power supplier, so as to control the amplitude of scan pulse, based on a second modified-structure.
Figure 10:
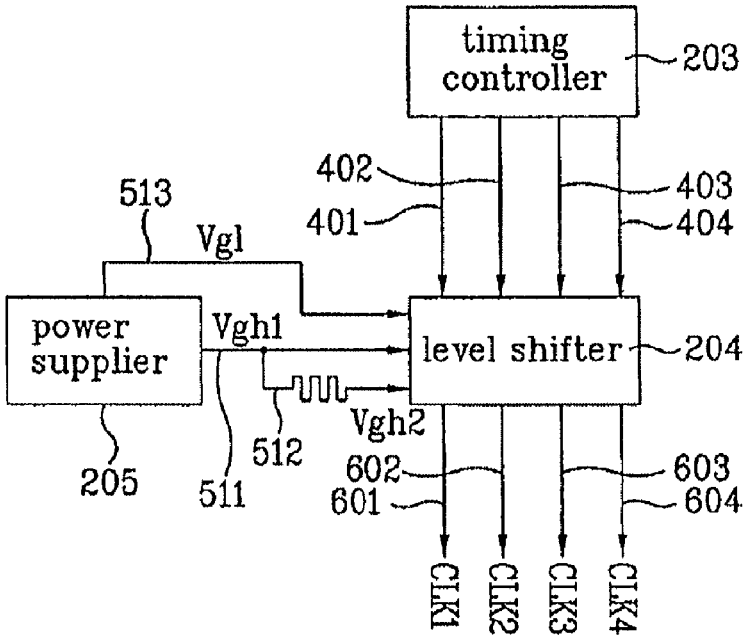
FIG. 10 is a view of illustrating a timing controller, a level shifter, and a power supplier, so as to control the amplitude of scan pulse, based on a third modified-structure.

FIG. 9 is a view of illustrating the timing controller, the level shifter, and the power supplier, so as to control the amplitude of scan pulse, based on a second modified-structure. FIG. 10 is a view of illustrating the timing controller, the level shifter, and the power supplier, so as to control the amplitude of scan pulse, based on a third modified-structure.

As shown in FIG. 9, the timing controller 203 outputs the plurality of clock pulses CLK1 to CLK4 provided with the phase difference. The level shifter 204 differently modulates the amplitude of clock pulses CLK1 to CLK4 outputted from the timing controller 203, and supplies the modulated ones to the shift register 202. The power supplier 205 supplies a first high-voltage source Vgh1, a second high-voltage source Vgh2, and a low-voltage source Vg1, which have the different values from one another, to the level shifter 204. The first to fourth clock pulses CLK1 to CLK4 outputted from the timing controller 203 have the same amplitude and the same pulse width. The first to fourth clock pulses CLK1 to CLK4 are supplied to the level shifter 204 through the first to fourth transmission lines 401 to 404.

First to third voltage-transmission lines 511 to 513 are connected between the power supplier 205 and the level shifter 204. The first voltage-transmission line 511 transmits the first high-voltage source Vgh1, wherein the first voltage-transmission line 511 is connected between the power supplier 205 and a first input terminal of the level shifter 204 in series. The second voltage-transmission line 512 transmits the second high-voltage source Vgh2, wherein the second voltage-transmission line 512 is connected between the first voltage-transmission line 511 and a second input terminal of the level shifter 204 in series. The third voltage-transmission line 513 transmits the low-voltage source Vg1, wherein the third voltage-transmission line 513 is connected between the power supplier 205 and a third input terminal of the level shifter 204 in series.

The resistance value of second voltage-transmission line 512 is different from the resistance value of first voltage-transmission line 511. The resistance value of second voltage-transmission line 512 is larger than the resistance value of first voltage-transmission line 511. For this, the second voltage-transmission line 512 is provided with a resistor (R). For example, the power supplier 205 reduces the first high-voltage source Vgh1 through the second voltage-transmission line 512 without additionally generating the second high-voltage source Vgh2. The power supplier 205 supplies the reduced one as the second high-voltage source Vgh2 to the level shifter 204.

The level shifter 204 generates the first and third clock pulses CLK1 and CLK3 of the first amplitude Vamp1 using the first high-voltage source Vgh1 and the low-voltage source Vg1 outputted from the power supplier 205; and generates the second and fourth clock pulses CLK2 and CLK4 of the second amplitude Vamp2 using the second high-voltage source Vgh2 and the low-voltage source Vg1. The first to fourth clock pulses CLK1 to CLK4 having the modulated amplitude are supplied to the shift register 202 through first to fourth output lines 601 to 604.

The first high-voltage source Vgh1 is larger than the second high-voltage source Vgh2, and the low-voltage source is smaller than the first high-voltage source Vgh1 and the second high-voltage source Vgh2. The first amplitude Vamp1 corresponds to the differential voltage between the low-voltage source Vg1 and the first high-voltage source Vgh1, and the second amplitude Vamp2 corresponds to the differential voltage between the low-voltage source Vg1 and the second high-voltage source Vgh2. When the width of second voltage-transmission line 512 is smaller than the width of first voltage-transmission line 511 without using the addition resistor, it is possible to increase the resistance value of second voltage-transmission line 512.

In another embodiment, as shown in FIG. 10, the second voltage-transmission line 512 may be formed in shape of zigzag so as to increase the resistance value of second voltage-transmission line 512.

In another embodiment, instead of using the fixed resistor R, a variable resistor may be used in order to freely change the resistance value of second high-voltage source Vgh2. By freely changing the resistance value of the second high-voltage source Vgh2, it is possible to change the amplitude of second and fourth clock pulses CLK2 and CLK4.

A variable resistor may be additionally provided in the first voltage-transmission line 511, so as to freely change the resistance value of the low-voltage source Vg1. By changing the resistance value of first high-voltage source Vgh1, it is possible to change the amplitude of first and third clock pulses CLK1 and CLK3.

Figure 11:
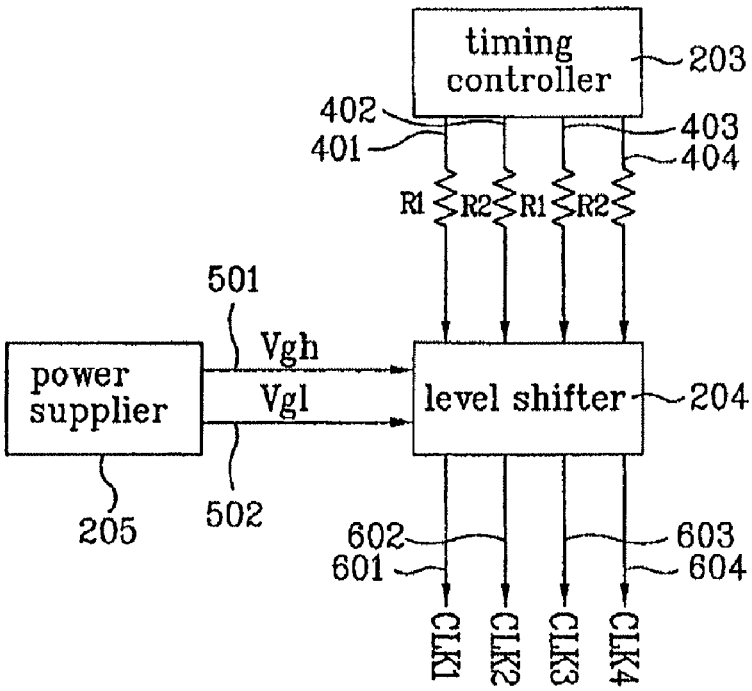
FIG. 11 is a view of illustrating a timing controller, a level shifter, and a power supplier, so as to control the amplitude of scan pulse, based on a fourth modified-structure.

FIG. 11 is a view of illustrating the timing controller, the level shifter, and the power supplier, so as to control the amplitude of scan pulse, based on a fourth modified-structure. As shown in FIG. 11, the timing controller 203 outputs the plurality of clock pulses CLK1 to CLK4 provided with the phase difference. The level shifter 204 modulates the amplitude of clock pulses CLK1 to CLK4 supplied from the timing controller 203 at the constant ratio, and supplies the modulated ones to the shift register 202. The power supplier 205 supplies a high-voltage source and a low-voltage source to the level shifter 204.

The first to fourth clock pulses CLK1 to CLK4 outputted from the timing controller 203 have the same amplitude and pulse width. The first to fourth clock pulses CLK1 to CLK4 having the different resistance values are supplied to the level shifter 204 through first to fourth transmission lines 401 to 404. The first and third transmission lines 401 and 403 have the same resistance value from each other, and the second and fourth transmission lines 402 and 404 have the same resistance value from each other.

The resistance value of first and third transmission lines 401 and 403 is different from the resistance value of second and fourth transmission lines 402 and 404. For example, the resistance value of second and fourth transmission lines 402 and 404 is larger than the resistance value of first and third transmission lines 401 and 403. Each of the first and third transmission lines 401 and 403 is provided with a first resistor R1, and each of the second and fourth transmission lines 402 and 404 is provided with a second resistor R2. The resistance value of the second resistor R2 is larger than the resistance value of the first resistor R1.

The amplitude of first clock pulse CLK1 supplied to the level shifter 204 through the first transmission line 401 is the same as the amplitude of third clock pulse CLK3 supplied to the level shifter 204 through the third transmission line 403. The amplitude of second clock pulse CLK2 supplied to the level shifter 204 through the second transmission line 402 is the same as the amplitude of fourth clock pulse CLK4 supplied to the level shifter 204 through the fourth transmission line 404. The amplitude of first and third clock pulses CLK1 and CLK3 is different from the amplitude of second and fourth clock pulses CLK2 and CLK4.

The level shifter 204 is supplied with the first to fourth clock pulses CLK1 to CLK4 having the modulated amplitude. The level shifter 204 changes the level of clock pulses CLK1 to CLK4 to be suitable for driving the gate line by using the high-voltage source Vgh and the low-voltage source Vg1 outputted from the power supplier 205. The first to fourth clock pulses CLK1 to CLK4 of which levels are changed at a constant ratio are maintained with the modulated amplitude. Thus, the amplitude of first clock pulse CLK1 (or the third clock pulse CLK3) outputted from the level shifter 204 is different from the amplitude of second clock pulse CLK2 (or the fourth clock pulse CLK4). The first to fourth clock pulses CLK1 to CLK4 are supplied to the shift register 202 through first to fourth output lines 601 to 604.

In order to increase the resistance value of second and fourth transmission lines 402 and 404 without using the additional resistors R1 and R2, the second and fourth transmission lines 402 and 404 may have a smaller width than those of first and third transmission lines 401 and 403.

In another embodiment, the second and fourth transmission lines 402 and 404 may be formed in shape of zigzag so as to increase the resistance value.

In another embodiment, instead of using the fixed resistors R1 and R2, a variable resistor may be used in order to freely change the amplitude of clock pulses CLK1 to CLK4.

Figure 12:
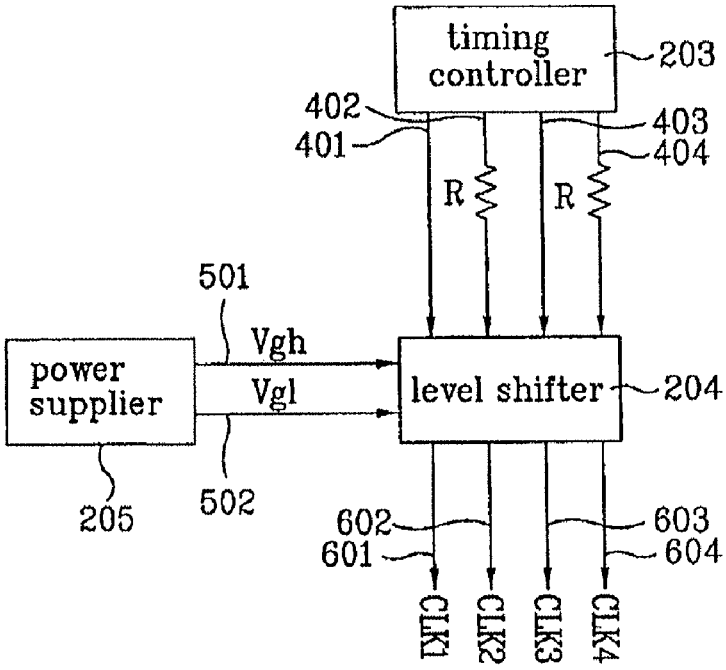
FIG. 12 is a view of illustrating a timing controller, a level shifter, and a power supplier, so as to control the amplitude of scan pulse, based on a fifth modified-structure.

FIG. 12 is a view of illustrating the timing controller, the level shifter, and the power supplier, so as to control the amplitude of scan pulse, based on a fifth modified-structure. The timing controller 203, the level shifter 204, and the power supplier shown in FIG. 12 are almost the same as those shown in FIG. 11. However, the first to fourth transmission lines 401 to 404 have the following structures. For example, the first and third transmission lines 401 and 403 are directly connected between the timing controller 203 and the level shifter 204. The second and fourth transmission lines 402 and 404 are connected between the timing controller 203 and the level shifter 204 through resistors R. The resistance value of second and fourth transmission lines 402 and 404 is larger than the resistance value of first and third transmission lines 401 and 403. The amplitude of first and third clock pulses CLK1 and CLK3 respectively outputted through the first and third transmission lines 401 and 403 is different from the amplitude of second and fourth clock pulses CLK2 and CLK4 respectively outputted through the second and fourth transmission lines 402 and 404. Instead of using the fixed resistor R, a variable resistor may be used so as to control the amplitude of second clock pulse CLK2 outputted through the second transmission line 402 and the amplitude of fourth clock pulse CLK4 outputted through the fourth transmission line 404.

Figure 13:
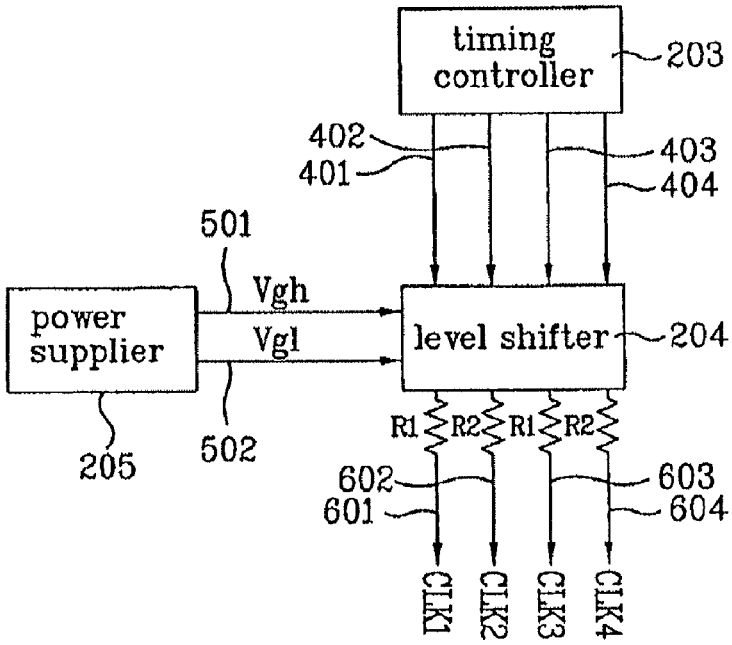
FIG. 13 is a view of illustrating a timing controller, a level shifter, and a power supplier, so as to control the amplitude of scan pulse, based on a sixth modified-structure.

FIG. 13 is a view of illustrating the timing controller, the level shifter, and the power supplier, so as to control the amplitude of scan pulse, based on a sixth modified-structure. As shown in FIG. 13, the timing controller 203 outputs the plurality of clock pulses provided with the phase difference. The level shifter 204 changes the level of clock pulses CLK1 to CLK4 outputted from the timing controller 203, and supplies the clock pulses CLK1 to CLK4 having the changed level to the shift register 202. The power supplier 205 supplies a high-voltage source Vgh and a low-voltage source Vg1 to the level shifter 204. The first to fourth clock pulses CLK1 to CLK4 outputted from the timing controller 203 have the same amplitude and the same pulse width. The first to fourth clock pulses CLK1 to CLK4 are supplied to the level shifter 204 through the first to fourth transmission lines 401 to 404.

The level shifter 204 is supplied with the first to fourth clock pulses CLK1 to CLK4. The level shifter 204 changes the level of clock pulses CLK1 to CLK4 to be suitable for driving the gate line by using the high-voltage source Vgh and the low-voltage source Vg1 outputted from the power supplier 205. The first to fourth clock pulses CLK1 to CLK4 are outputted from the level shifter 204, and are then supplied to the shift register 202 through first to fourth output lines 601 to 604. The first and third output lines 601 and 603 have the same resistance value, and the second and fourth output lines 602 and 604 have the same resistance value.

The resistance value of first and third output lines 601 and 603 is different from the resistance value of second and fourth output lines 602 and 604. The resistance value of second and fourth output lines 602 and 604 is larger than the resistance value of first and third output lines 601 and 603. Each of the first and third output lines 601 and 603 is provided with a first resistor R1, and each of the second and fourth output lines 602 and 604 is provided with a second resistor R2, wherein the resistance value of second resistor R2 is larger than the resistance value of first resistor R1.

The amplitude of first clock pulse CLK1 supplied to the shift register 202 through the first output line 601 is the same as the amplitude of third clock pulse CLK3 supplied to the shift register 202 through the third output line 603. The amplitude of second clock pulse CLK2 supplied to the shift register 202 through the second output line 602 is the same as the amplitude of fourth clock pulse CLK4 supplied to the shift register 202 through the fourth output line 604. However, the amplitude of first and third clock pulses CLK1 and CLK3 is different from the amplitude of second and fourth clock pulses CLK2 and CLK4.

In order to increase the resistance value of second and fourth output lines 602 and 604 without using the additional resistors R1 and R2, the second and fourth output lines 602 and 604 may have the smaller width than those of first and third output lines 601 and 603.

In another embodiment, the second and fourth output lines 602 and 604 may be formed in shape of zigzag so as to increase the resistance value of second and fourth output lines 602 and 604.

In another embodiment, instead of using the fixed resistor R1, R2, a variable resistor may be used in order to freely change the amplitude of clock pulses CLK1 to CLK4.

Figure 14:
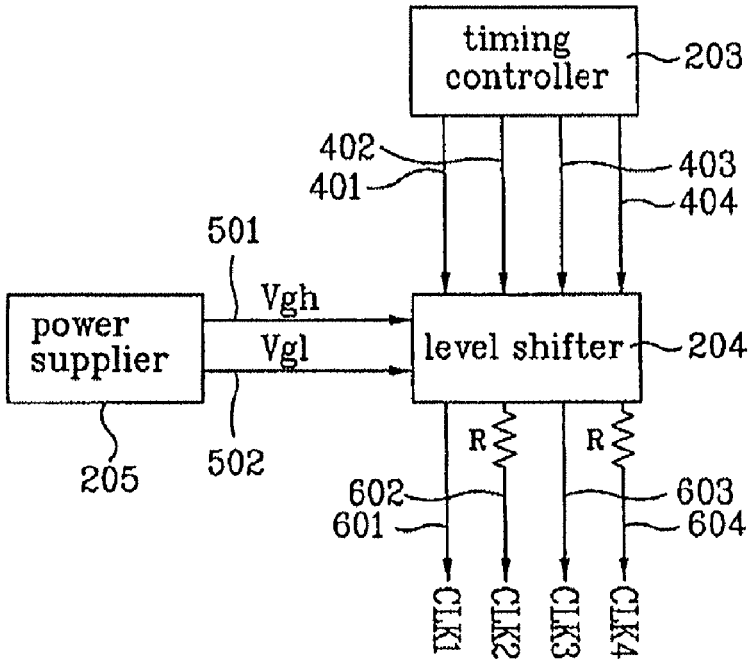
FIG. 14 is a view of illustrating a timing controller, a level shifter, and a power supplier, so as to control the amplitude of scan pulse, based on a seventh modified-structure.

FIG. 14 is a view of illustrating the timing controller, the level shifter, and the power supplier, so as to control the amplitude of scan pulse, based on a seventh modified-structure. The timing controller 203, the level shifter 204, and the power supplier 205 shown in FIG. 14 are almost the same as those shown in FIG. 13. However, the first to fourth output lines 601 and 604 have the following structures. For example, the first and third output lines 601 and 603 are directly connected between the level shifter 204 and the shift register 202. The second and fourth output lines 602 and 604 are connected between the level shifter 204 and the shift register 202 through resistors R. Accordingly, the resistance value of second and fourth output lines 602 and 604 is larger than the resistance value of first and third output lines 601 and 603. As a result, the amplitude of first and third clock pulses CLK1 and CLK3 respectively outputted through the first and third output lines 601 and 603 is different from the amplitude of second and fourth clock pulses CLK2 and CLK4 respectively outputted through the second and fourth output lines 602 and 604.

Instead of using the fixed resistor R, a variable resistor may be used in order to control the amplitude of second clock pulse CLK2 outputted through the second output line 602 and the amplitude of fourth clock pulse CLK4 outputted through the fourth output line 604.

In order to obtain the different amplitudes in the respective clock pulses CLK1 to CLK4, first to fourth clock transmission lines 801 and 804 may have different widths from one another.

Figure 15:
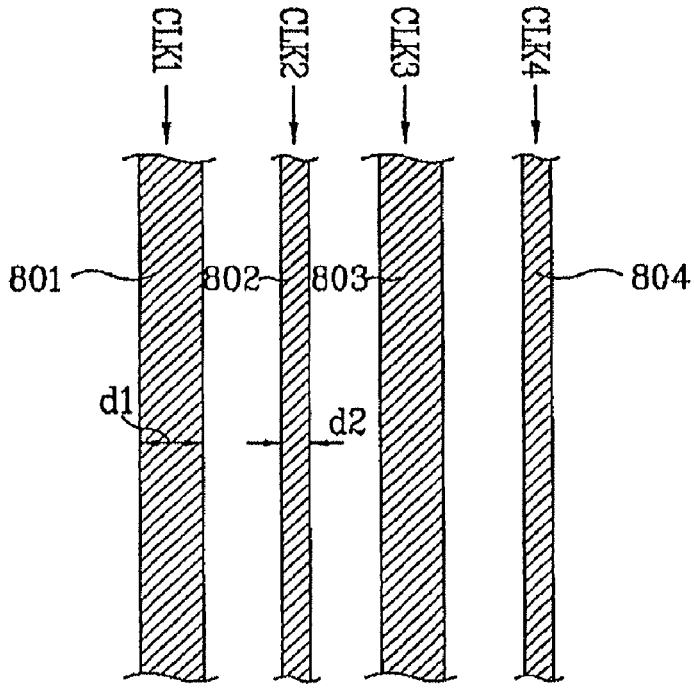
FIG. 15 is a view of illustrating first to fourth clock transmission lines of FIG. 6.

FIG. 15 is a view of illustrating the first to fourth clock transmission lines of FIG. 6. The timing controller 203, the level shifter 204, and the power supplier 205 may be operated as follows.

The timing controller 203 outputs the plurality of clock pulses CLK1 to CLK4 provided with the phase difference. The timing controller 203 changes the level of clock pulses CLK1 to CLK4 outputted from the timing controller 203, and supplies the clock pulses having the changed level to the shift register 202. The power supplier 205 supplies the high-voltage source Vgh and the low-voltage source Vg1 to the level shifter 204. The first to fourth clock pulses CLK1 to CLK4 outputted from the timing controller 203 have the same amplitude and pulse width. The first to fourth clock pulses CLK1 to CLK4 are supplied to the level shifter 204 through the first to fourth transmission lines 401 to 404.

The level shifter 204 is supplied with the first to fourth clock pulses CLK1 to CLK4. The level shifter 204 changes the level of clock pulses CLK1 to CLK4 to be suitable for driving the gate line by using the high-voltage source Vgh and the low-voltage source Vg1 outputted from the power supplier 205. The first to fourth clock pulses CLK1 to CLK4 outputted from the shift register 204 are supplied to the first to fourth clock transmission lines 801 to 804 through the first to fourth output lines 601 and 604.

As shown in FIG. 15, the first and third clock transmission lines 801 and 803 have the same width, for example, each of the first and third clock transmission lines 801 and 803 has the width of 'd1'. The second and fourth clock transmission lines 802 and 804 have the same width, for example, each of the second and fourth clock transmission lines 802 and 804 has the width of 'd2'. The width 'd1' of each of the first and third clock transmission lines 801 and 803 is larger than the width 'd2' of each of the second and fourth clock transmission lines 802 and 804. Accordingly, the amplitude of first and third clock pulses CLK1 and CLK3 supplied to the shift register 202 through the respective first and third clock transmission lines 801 and 803 is larger than the amplitude of second and fourth clock pulses CLK2 and CLK4 supplied to the shift register 202 through the respective second and fourth clock transmission lines 802 and 804.

In another embodiment, the first and third clock transmission lines 801 and 803 are formed in shape of straight line, and the second and fourth clock transmission lines 802 and 804 are formed in shape of zigzag. The resistance value of second and fourth clock transmission lines 802 and 804 is larger than the resistance value of first and third clock transmission lines 801 and 803.

On maintaining the constant width of clock transmission lines 801 to 804, the resistors having the different resistance values are provided to the respective clock transmission lines 801 and 804, whereby the clock pulses have the different amplitudes from one another. Since the clock transmission lines 801 and 804 are provided in a small area corresponding to the periphery of LCD panel 300, it is preferable to change the width of clock transmission lines 801 to 804 instead of additionally using the large-sized resistor.

Figure 16:
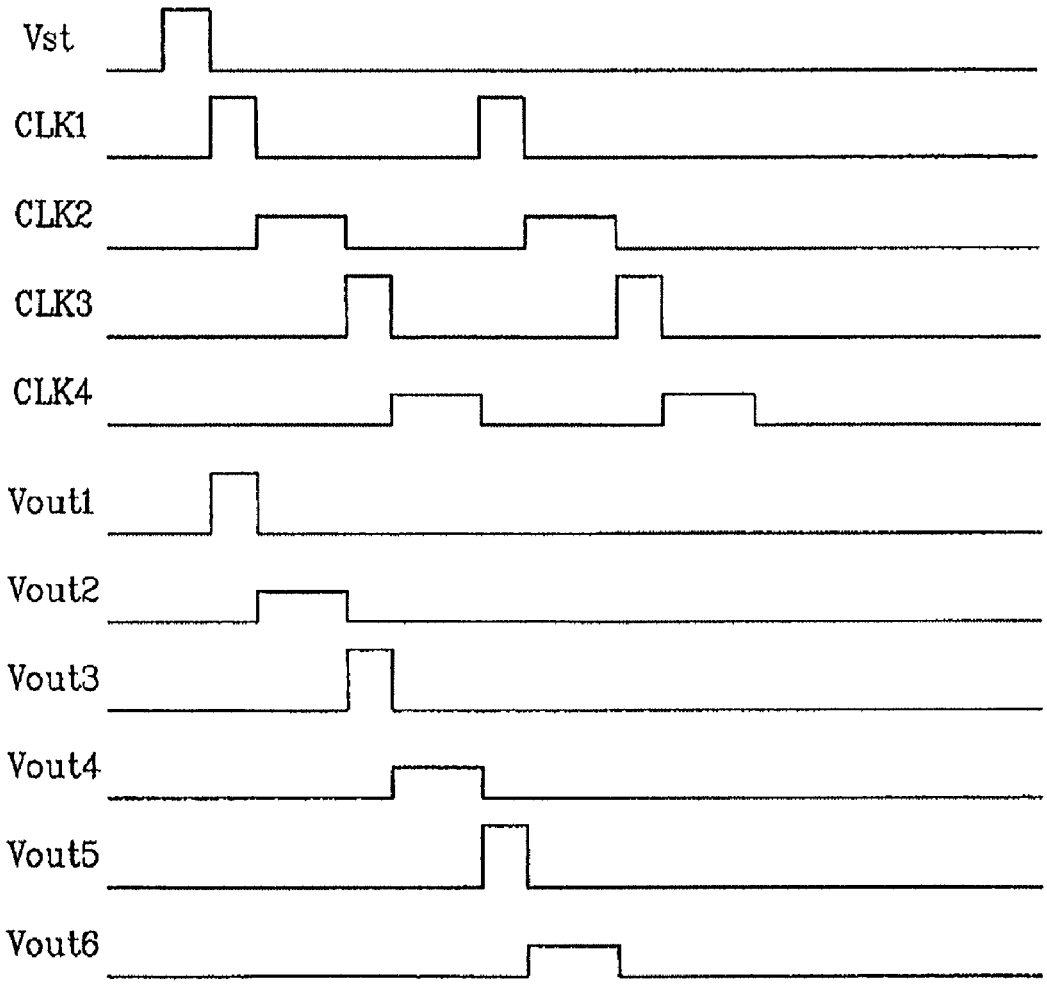
FIG. 16 is a timing view of other clock pulses supplied to the shift register of FIG. 6 and outputted from the shift register.

FIG. 16 is a timing view of other clock pulses supplied to the shift register of FIG. 6 and outputted from the shift register. As shown in FIG. 16, the shift register 202 outputs the scan pulses Vout1 to Voutn provided with the different amplitudes and pulse widths. The shift register 202 is supplied with the clock pulses CLK1 to CLK4 having the different amplitudes and the different pulse widths. The amplitude of first and third clock pulses CLK1 and CLK3 is larger than the amplitude of second and fourth clock pulses CLK2 and CLK4. Meanwhile, the pulse width of first and third clock pulses CLK1 and CLK3 is smaller than the pulse width of second and fourth clock pulses CLK2 and CLK4. The amplitude of clock pulses CLK1 to CLK4 may be controlled by the above-mentioned method. The pulse width of clock pulses CLK1 to CLK4 may be controlled in the timing controller 203.

After outputting the 'k'th clock pulse, the 'k+1'th clock pulse is outputted past a predetermined margin time. The 'k+1'th clock pulse is not promptly rising to a rising edge from a falling edge of the 'k'th clock pulse. The 'k+1'th clock pulse rises to the rising edge from the falling edge of the 'k'th clock pulse after the predetermined margin time ('k' is an integer inclusive of '0'). During the margin time, it is possible to control the pulse width of each clock pulse. For example, the first and third clock pulses CLK1 and CLK3 are maintained with the original amplitude and the original pulse width. However, the amplitude of second and fourth clock pulses CLK2 and CLK4 is smaller than the amplitude of first and third clock pulses CLK1 and CLK3, and the pulse width of second and fourth clock pulses CLK2 and CLK4 is larger than the pulse width of first and third clock pulses CLK1 and CLK3.

The amplitude and pulse width may be controlled by differently applying an RC time constant based on the resistor and capacitor. This will be explained in detail. The original clock pulse is distorted using the resistor and capacitor, thereby increasing the rising and falling time of clock pulse, for example, pulse width.

Figure 17:
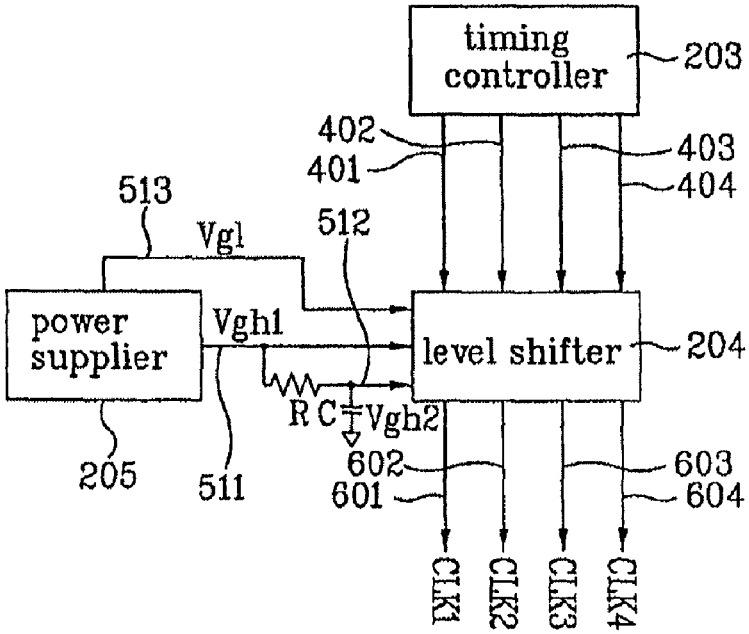
FIG. 17 is a view of illustrating a timing controller, a level shifter, and a power supplier, so as to control the amplitude and pulse width of scan pulse, based on a first modified-structure.

FIG. 17 is a view of illustrating the timing controller, the level shifter, and the power supplier, so as to control the amplitude and pulse width, based on a first modified-structure. The timing controller 203, the level shifter 204, and the power supplier 205 of FIG. 17 are substantially identical to those of FIG. 9, whereby the detailed explanation will be omitted. As shown in FIG. 17, a capacitor C is connected with one side of second voltage-transmission line 512. By providing the capacitor C, a second high-voltage source Vgh2 supplied to the level shifter 204 through the second voltage-transmission line 512 has the time constant which is higher than that of a first high-voltage source Vgh1. Accordingly, the amplitude of second and fourth clock pulses CLK2 and CLK4 generated from the level shifter 204 by the second high-voltage source Vgh2 and low-voltage source Vg1 is smaller than the amplitude of first and third clock pulses CLK1 and CLK3, and the pulse width of second and fourth clock pulses CLK2 and CLK4 is larger than the pulse width of first and third clock pulses CLK1 and CLK3.

Figure 18:
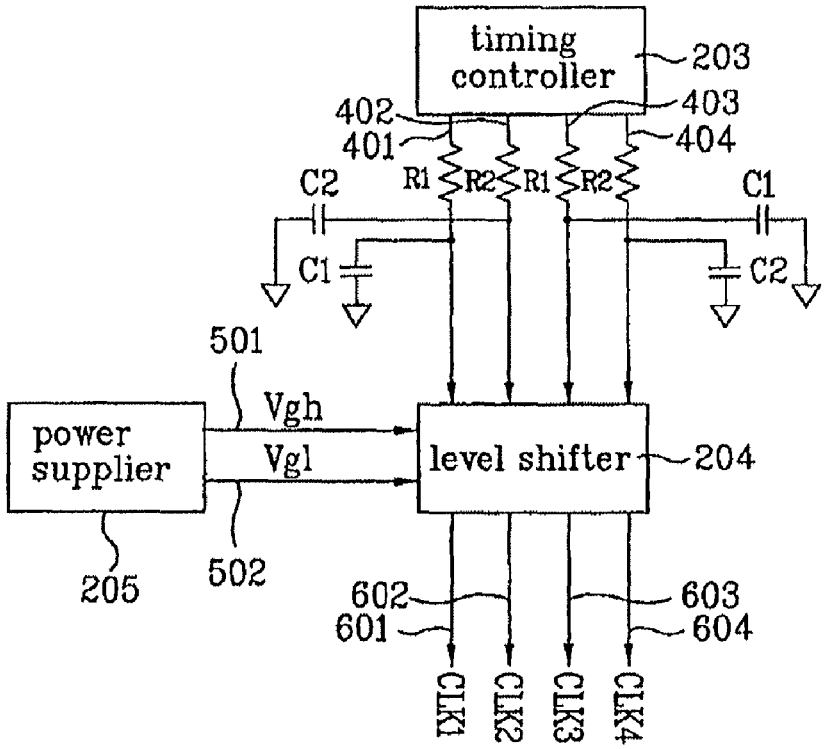
FIG. 18 is a view of illustrating a timing controller, a level shifter, and a power supplier, so as to control the amplitude and pulse width of scan pulse, based on a second modified-structure.

FIG. 18 is a view of illustrating the timing controller, the level shifter, and the power supplier, so as to control the amplitude and pulse width of scan pulse, based on a second modified-structure. The timing controller 203, the level shifter 204, and the power supplier 205 of FIG. 18 are substantially identical to those of FIG. 11, whereby the detailed explanation will be omitted. As shown in FIG. 18, a first capacitor C1 is connected with one side of each of first and third transmission lines 401 and 403.

A second capacitor C2 is connected with one side of each of second and fourth transmission lines 402 and 404. The capacitance of second capacitor C2 is higher than the capacitance of first capacitor C1. By providing the second capacitor C2, the second and fourth clock pulses CLK2 and CLK4 supplied to the level shifter 204 through the second and fourth transmission lines 402 and 404 have the time constant which is higher than that of the first and third clock pulses CLK1 and CLK3. Accordingly, the amplitude of second and fourth clock pulses CLK2 and CLK4 generated from the level shifter 204 is smaller than the amplitude of first and third clock pulses CLK1 and CLK3, and the pulse width of second and fourth clock pulses CLK2 and CLK4 is larger than the pulse width of first and third clock pulses CLK1 and CLK3.

Figure 19:
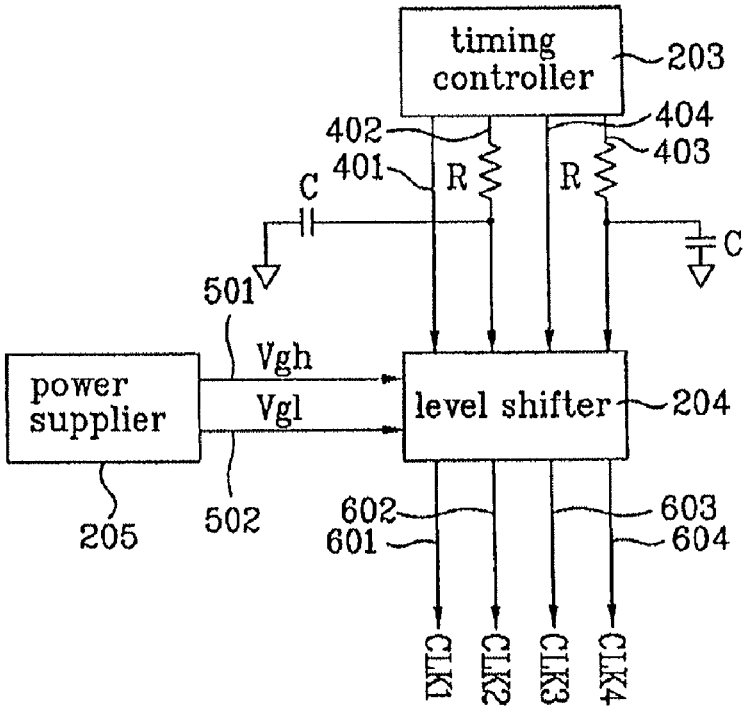
FIG. 19 is a view of illustrating a timing controller, a level shifter, and a power supplier, so as to control the amplitude of pulse width of scan pulse, based on a third modified-structure.

FIG. 19 is a view of illustrating the timing controller, the level shifter, and the power supplier, so as to control the amplitude and pulse width, based on a third modified-structure. The timing controller 203, the level shifter 204, and the power supplier 205 of FIG. 19 are substantially identical to those of FIG. 12, whereby the detailed explanation will be omitted. As shown in FIG. 19, a capacitor C is connected with one side of each of second and fourth transmission lines 402 and 404. By providing the capacitor C, the second and fourth clock pulses CLK2 and CLK4 supplied to the level shifter 204 through the second and fourth transmission lines 402 and 404 have the time constant which is higher than that of the first and third clock pulses CLK1 and CLK3. Accordingly, the amplitude of second and fourth clock pulses CLK2 and CLK4 generated from the level shifter 204 is smaller than the amplitude of first and third clock pulses CLK1 and CLK3, and the pulse width of second and fourth clock pulses CLK2 and CLK4 is larger than the pulse width of first and third clock pulses CLK1 and CLK3.

Figure 20:
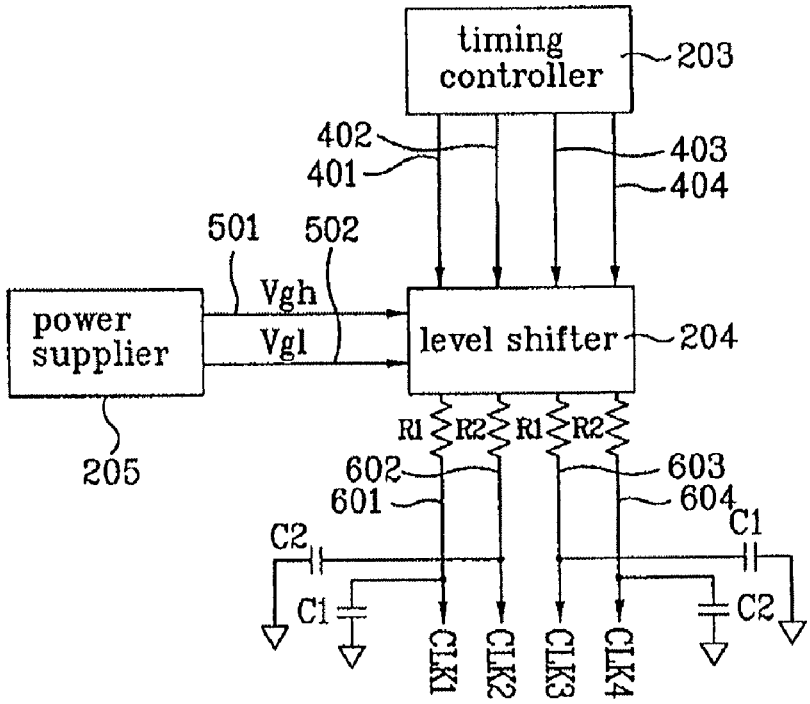
FIG. 20 is a view of illustrating a timing controller, a level shifter, and a power supplier, so as to control the amplitude and pulse width of scan pulse, based on a fourth modified-structure.

FIG. 20 is a view of illustrating the timing controller, the level shifter, and the power supplier, so as to control the amplitude and pulse width, based on a fourth modified-structure. The timing controller 203, the level shifter 204, and the power supplier 205 of FIG. 20 are identical to those of FIG. 13, whereby the detailed explanation will be omitted. As shown in FIG. 20, a first capacitor C1 is connected with one side of each of first and third output lines 601 and 603, and a second capacitor C2 is connected with one side of each of second and fourth output lines 602 and 604. The capacitance of second capacitor 02 is higher than the capacitance of first capacitor C1. By providing the second capacitor C2, the second and fourth clock pulses CLK2 and CLK4 supplied to the shift register 202 through the second and fourth output lines 602 and 604 have the time constant which is higher than that of the first and third clock pulses CLK1 and CLK3. Accordingly, the amplitude of second and fourth clock pulses CLK2 and CLK4 generated from the level shifter 204 is smaller than the amplitude of first and third clock pulses CLK1 and CLK3, and the pulse width of second and fourth clock pulses CLK2 and CLK4 is larger than the pulse width of first and third clock pulses CLK1 and CLK3.

Figure 21:
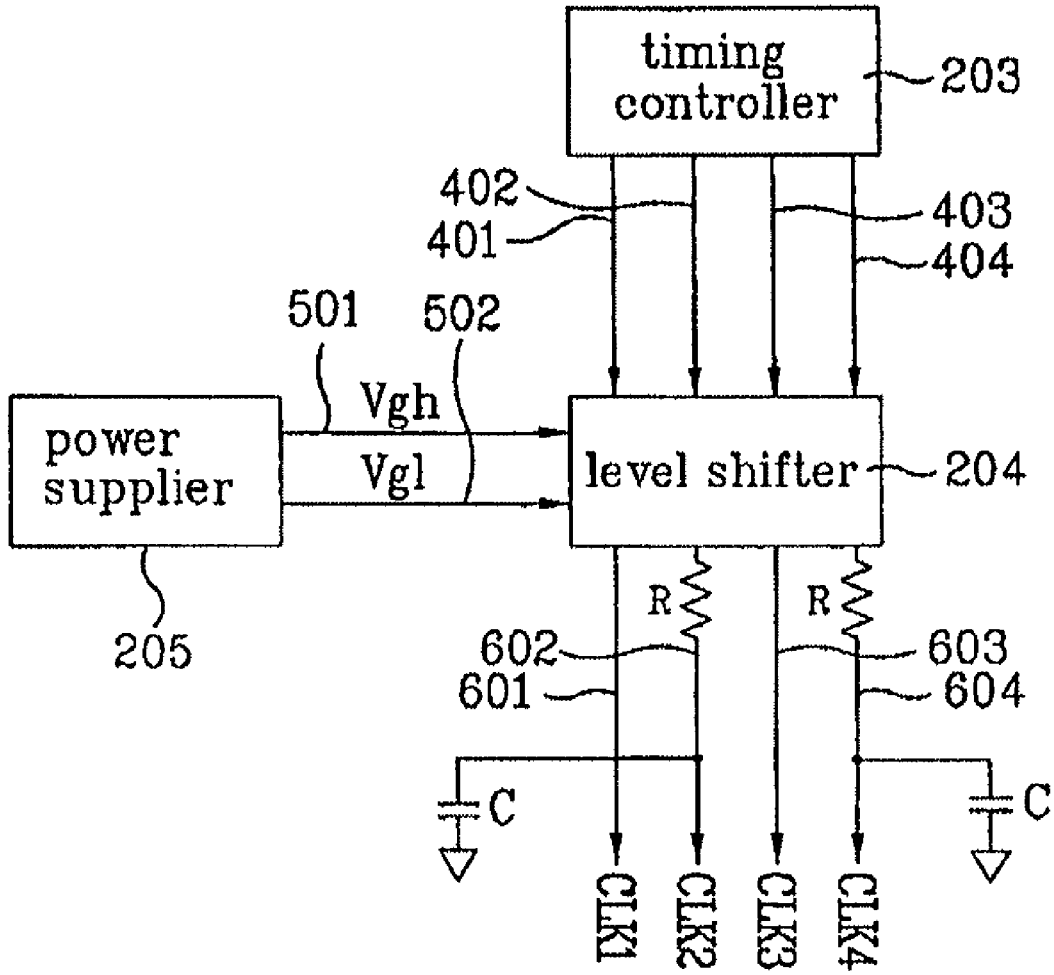
FIG. 21 is a view of illustrating a timing controller, a level shifter, and a power supplier, so as to control the amplitude and pulse width of scan pulse, based on a fifth modified-structure.

FIG. 21 is a view of illustrating the timing controller, the level shifter, and the power supplier, so as to control the amplitude and pulse width, based on a fifth modified-structure. The timing controller 203, the level shifter 204, and the power supplier of FIG. 21 are substantially identical to those of FIG. 14, whereby the detailed explanation will be omitted. As shown in FIG. 21, a capacitor C is connected with one side of each of second and fourth output lines 602 and 604. By providing the capacitor C, the second and fourth clock pulses CLK2 and CLK4 supplied to the shift register 22 through the second and fourth output lines 602 and 604 have the time constant which is higher than that of the first and third clock pulses CLK1 and CLK3. Accordingly, the amplitude of second and fourth clock pulses CLK2 and CLK4 outputted from the level shifter 204 is smaller than the amplitude of first and third clock pulses CLK1 and CLK3, and the pulse width of second and fourth clock pulses CLK2 and CLK4 is larger than the pulse width of first and third clock pulses CLK1 and CLK3.

The capacitor C connected with the second voltage-transmission line 512, the second capacitor C2 connected with the second and fourth transmission lines 402 and 404, or the second capacitor 02 connected with the second and fourth output lines 602 and 604 is charged with the capacitance which is higher than a reference capacitance, so that the output periods of clock pulses CLK1 to CLK4 may be have the active state concurrently during a predetermined duration. This will be explained in detail.

Figure 22:
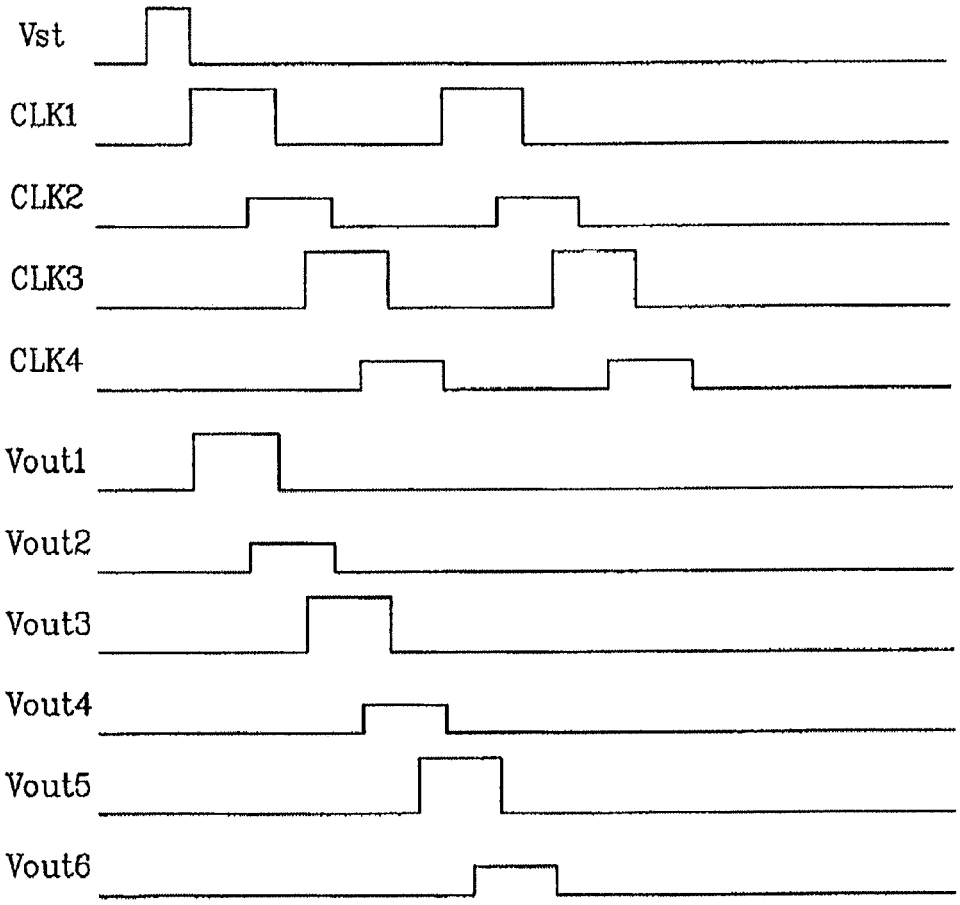
FIG. 22 is a timing view of other clock pulses supplied to the shift register of FIG. 6 and outputted from the shift register.

FIG. 22 is a timing view of other clock pulses supplied to the shift register of FIG. 6 and outputted from the shift register. As shown in FIG. 22, the neighboring clock pulses CLK1 to CLK4 are partially overlapped at highstate. Accordingly, the 'k+1'th gate line charged by the 'k+1'th clock pulse is preliminarily charged in the overlap section of outputting the 'k'th clock pulse and the 'k+1'th clock pulse. The 'k+1'th gate line is charged with the target voltage value in the section of outputting the 'k+1'th clock pulse and in the overlap section of outputting the 'k+1'th clock pulse and the 'k+2'th clock pulse. The shift register 202 supplied with the clock pulses outputs the scan pulses Vout1 to Voutn shown in FIG. 22.

Figure 23:
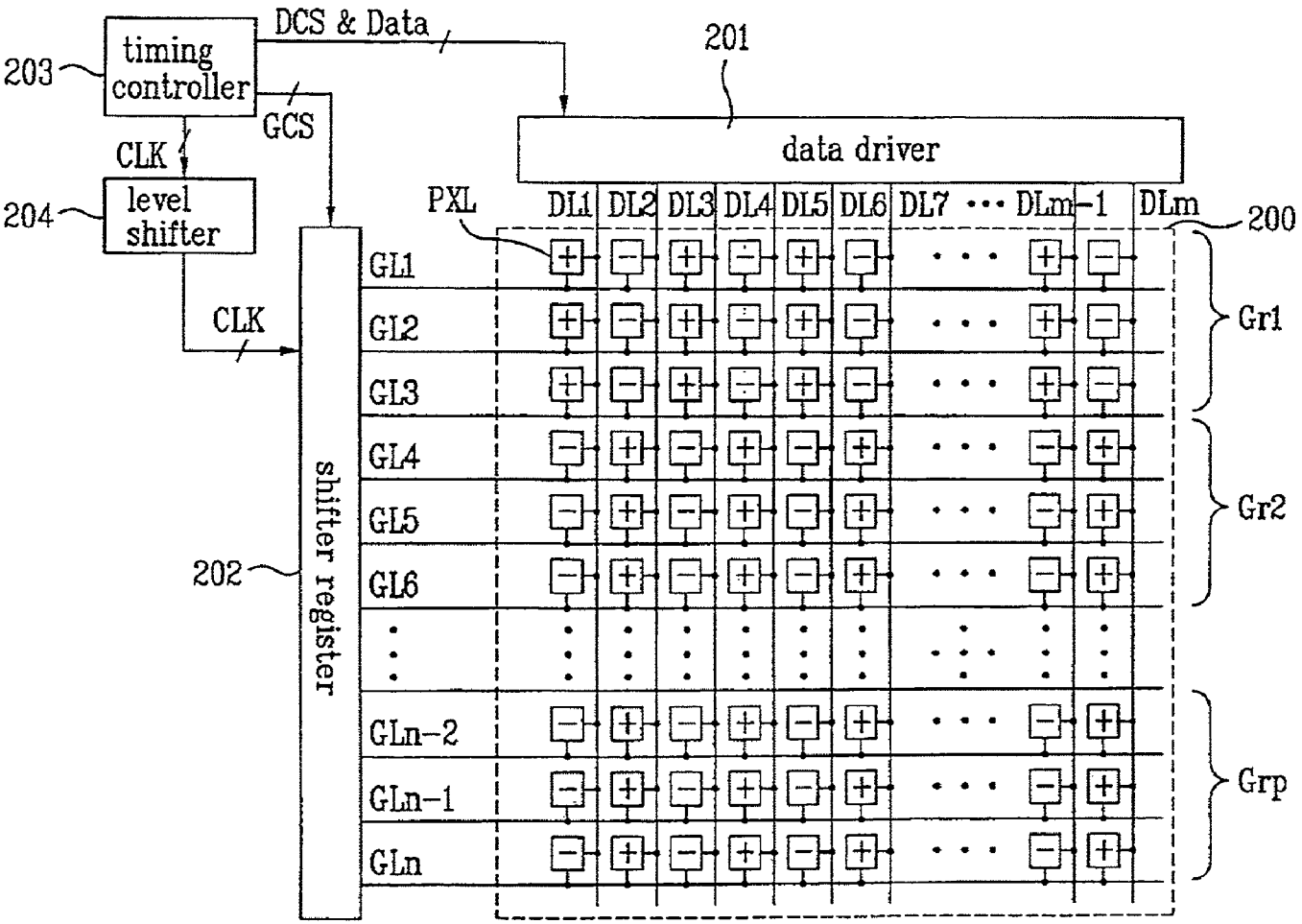
FIG. 23 is a view of illustrating a display device according to the second embodiment.
Figure 24:
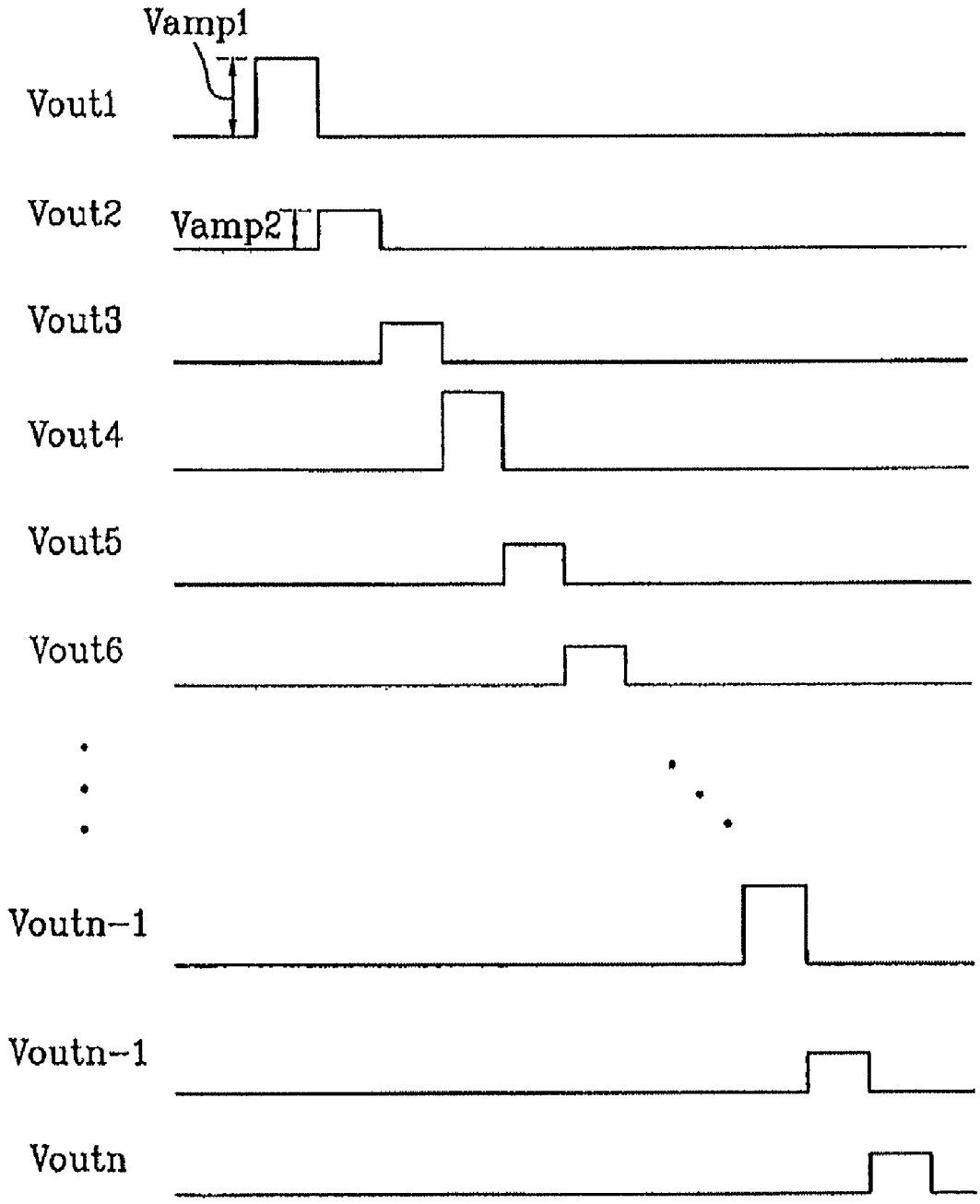
FIG. 24 is a timing view of scan pulses supplied to gate lines of FIG. 23.

FIG. 23 illustrates one embodiment a display device. As shown in FIG. 23, each of pixel-cell groups Gr1 to Grp is provided with three pixel cells PXL. FIG. 24 is a timing view of scan pulses supplied to gate lines of FIG. 23. As shown in FIG. 24, the scan pulses Vout1 to Voutn have the different pulse widths.

The pixel cells PXL connected with odd-numbered data lines DL1, DL3, . . . , DLm-1 and included in odd-numbered pixel-cell groups Gr1, Gr3, . . . , Grp-1 are supplied with the data signal of positive polarity. Also, the pixel cells PXL connected with odd-numbered data lines DL1, DL3, . . . , DLm-1 and included in even-numbered pixel-cell groups Gr2, Gr4, . . . , Grp are supplied with the data signal of negative polarity.

The pixel cells PXL connected with even-numbered data lines DL2, DL4, . . . , DLm and included in the odd-numbered pixel-cell groups Gr1, Gr3, . . . , Grp-1 are supplied with the data signal of negative polarity. AThe pixel cells PXL connected with the even-numbered data lines DL2, DL4, . . . , DLm and included in the even-numbered pixel-cell groups Gr2, Gr4, . . . , Grp are supplied with the data signal of positive polarity.

The pixel cells PXL connected with one data line in common are supplied with the data signals of the different polarities by each pixel-cell group. For example, the three pixel cells PXL connected with the first data line DL1 and included in the first pixel-cell group Gr1 are supplied with the data signal of positive polarity. The three pixel cells PXL connected with the first data line DL1 and included in the second pixel-cell group Gr2 are supplied with the data signal of negative polarity. The data driver 201 changes the polarity of data signal supplied to the data lines DL1 to DLm by each frame. As a result, the pixel cells PXL of the odd-numbered frame are supplied with the same polarity as show in FIG. 23, and the pixel cells PXL of the even-numbered frame are supplied with the opposite polarity of FIG. 23. The data driver 201 drives the display device by 3-dot driving mode.

The shift register 202 drives the first to 'n'th gate lines GL1 to GLn in sequence. For the pixel cells PXL connected with one data line in common, the gate line connected with the firstly-driven pixel cell among the pixel cells provided with the data signals of different polarities is supplied with the scan pulse having the second amplitude Vamp2, and the gate line connected with the secondly-driven pixel cell is supplied with the scan pulse having the first amplitude Vamp1.

As mentioned above, the display device according to the present invention and the driving method thereof have the following advantages.

In the display device according to the present invention, the scan pulses having the different amplitudes and pulse widths are supplied to the pixel cells provided with the data signals of different polarities, so that it is possible to prevent the luminance deviation between each of the pixel cells.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A display device comprising:

a display area which includes a plurality of pixel cells in respective pixel regions defined by a plurality of gate and data lines crossing each other;

a data driver that is operable to supply data signals to the pixel cells, wherein the pixel cells connected with the first data line are divided into a plurality of pixel-cell groups, each group provided with at least two pixel cells, and the data driver being operable to supply the data signal of first polarity to the pixel cells included in odd-numbered pixel-cell groups, and operable to supply the data signal of second polarity to the pixel cells included in even-numbered pixel-cell groups, wherein the first polarity is opposite to the second polarity; and a shift register that is operable to drive the gate lines to supply scan pulses of different amplitudes to neighboring pixel cells included in the different pixel-cell groups;

a timing controller that is operable to output 'n' clock pulses provided with the phase difference;

a level shifter that is operable to modulate the amplitude of clock pulses outputted from the timing controller at a constant ratio, and supplies the clock pulses having the modulated amplitude to the shift register; and 'n' transmission lines that are provided with the different resistance values, and are operable to supply the 'n' clock pulses outputted from the timing controller to the level shifter.

2. The display device of claim 1, wherein each of 'm' transmission lines (where 'm' is an integer smaller than 'n') is connected between the timing controller and the level shifter through a first resistor, and each of 'n−m' transmission lines is connected between the timing controller and the level shifter through a second resistor.

3. The display device of claim 2, wherein the first and second resistors are variable resistors.

4. The display device of claim 1, wherein each of the 'm' transmission lines is directly connected between the timing controller and the level shifter, and 'n−m' transmission lines are connected between the timing controller and the level shifter through at least one resistor.

5. The display device of claim 4, wherein the resistor is a variable resistor.

6. The display device of claim 1, wherein the width of each of 'm' transmission lines (where 'm' is an integer smaller than 'n') is larger than the width of each of 'n−m' transmission lines.

7. The display device of claim 1, wherein the 'm' transmission lines (where 'm' is an integer smaller than 'n') are zigzag shaped.

8. The display device of claim 1, wherein the data driver is operable to supply data signals to the pixel cells, wherein the pixel cells connected with the second data line are divided into a plurality of pixel-cell groups, each group provided with at least two pixel cells, and the data driver supplies the data signal of second polarity to the pixel cells of the odd-numbered pixel-cell groups, and supplies the data signal of first polarity to the pixel cells of the even-numbered pixel-cell groups.

9. A display device comprising:

a display area which includes a plurality of pixel cells in respective pixel regions defined by a plurality of gate and data lines crossing each other;

a data driver that is operable to supply data signals to the pixel cells, wherein the pixel cells connected with the first data line are divided into a plurality of pixel-cell groups, each group provided with at least two pixel cells, and the data driver being operable to supply the data signal of first polarity to the pixel cells included in odd-numbered pixel-cell groups, and operable to supply the data signal of second polarity to the pixel cells included in even-numbered pixel-cell groups, wherein the first polarity is opposite to the second polarity; and a shift register that is operable to drive the gate lines to supply scan pulses of different amplitudes to neighboring pixel cells included in the different pixel-cell groups;

a timing controller that is operable to output the plurality of clock pulses provided with the phase difference;

a level shifter that is operable to modulate the amplitude of clock pulses outputted from the timing controller at a constant ratio, and supply the modulated clock pulses through 'n' output lines; and a shift register which is supplied with the clock pulses through 'n' clock transmission lines respectively connected with one end of the 'n' output lines, wherein the 'n' output lines have the different resistance values from one another.

10. The display device of claim 9, wherein the 'm' output lines ('m' is an integer smaller than 'n') are connected between the level shifter and the 'm' clock transmission lines through a first resistor, and the 'n−m' output lines are connected between the level shifter and the 'n−m' clock transmission lines through a second resistor.

11. The display device of claim 10, wherein the resistance value of first resistor is smaller than the resistance value of second resistor.

12. The display device of claim 10, wherein the first and second resistors are variable resistors.

13. The display device of claim 12, wherein the resistance value of first resistor is smaller than the resistance value of second resistor.

14. The display device of claim 9, wherein each of 'm' output lines (where 'm' is an integer smaller than 'n') is directly connected between the level shifter and each of 'm' clock transmission lines, and each of 'n−m' output lines is connected between the level shifter and each of 'n−m' clock transmission lines through at least one resistor.

15. The display device of claim 9, wherein the resistor is a variable resistor.

16. The display device of claim 9, wherein the width of each of 'm' output lines (where 'm' is an integer smaller than 'n') is larger than the width of each of 'n−m' output lines.

17. A display device comprising:

a display area which includes a plurality of pixel cells in respective pixel regions defined by a plurality of gate and data lines crossing each other;

a data driver that is operable to supply data signals to the pixel cells, wherein the pixel cells connected with the first data line are divided into a plurality of pixel-cell groups, each group provided with at least two pixel cells, and the data driver being operable to supply the data signal of first polarity to the pixel cells included in odd-numbered pixel-cell groups, and operable to supply the data signal of second polarity to the pixel cells included in even-numbered pixel-cell groups, wherein the first polarity is opposite to the second polarity; and a shift register that is operable to drive the gate lines to supply scan pulses of different amplitudes to neighboring pixel cells included in the different pixel-cell groups;

a timing controller that is operable to output 'n' clock pulses provided with a phase difference;

a level shifter that is operable to modulate the amplitude of 'n' clock pulses outputted from the timing controller at a constant ratio, and supply the modulated 'n' clock pulses to the shift register; and 'n' clock transmission lines which are provided with the different resistance values, and are operable to transmit the 'n' clock pulses outputted from the level shifter to the shift register.

18. The display device of claim 17, wherein each of 'm' clock transmission lines is connected between the level shifter and the shift register through a first resistor, and each of 'n−m' clock transmission lines is connected between the level shifter and the shift register through a second resistor.

19. The display device of claim 18, wherein the resistance value of the first resistor is smaller than the resistance value of the second resistor.

20. The display device of claim 19, wherein each of the 'm' clock transmission lines is directly connected between the level shifter and the shift register, and each of the 'n−m' clock transmission lines is connected between the level shifter and the shift register through a resistor.

21. The display device of claim 20, wherein the resistor is a variable resistor.

22. The display device of claim 19, wherein the width of each of 'm' clock transmission lines (where 'm' is an integer smaller than 'n') is larger than the width of each of 'n−m' clock transmission lines.

23. The display device of claim 18, wherein the first and second resistors are variable resistors.

24. The display device of claim 18, wherein the 'm' clock transmission lines (where 'm' is an integer smaller than 'n') are zigzag shaped.

25. A display device comprising:

a display area which includes a plurality of pixel cells in respective pixel regions defined by a plurality of gate and data lines crossing each other;

a data driver that is operable to supply data signals to the pixel cells, wherein the pixel cells connected with the first data line are divided into a plurality of pixel-cell groups, each group provided with at least two pixel cells, and the data driver being operable to supply the data signal of first polarity to the pixel cells included in odd-numbered pixel-cell groups, and operable to supply the data signal of second polarity to the pixel cells included in even-numbered pixel-cell groups, wherein the first polarity is opposite to the second polarity; and a shift register that is operable to drive the gate lines to supply scan pulses of different amplitudes to neighboring pixel cells included in the different pixel-cell groups;

a timing controller that is operable to output the clock pulses provided with the phase difference, wherein the neighboring clock pulses outputted at the adjacent time periods have the active state concurrently during a predetermined duration; and a level shifter is operable to differently modulate the amplitude of clock pulses outputted from the timing controller, and supply the modulated clock pulses to the shift register;

wherein the shift register is operable to output the scan pulses such that neighboring scan pulses outputted at the adjacent time periods have the active state concurrently during a predetermined duration.

26. A display device comprising:

a display area that includes a plurality of pixel cells in respective pixel regions defined by a plurality of gate and data lines crossing each other;

a data driver that is operable to supply data signals to the pixel cells, wherein the pixel cells connected with the first data line are divided into a plurality of pixel-cell groups, each group provided with at least two pixel cells, wherein the data driver is operable to supply the data signal of first polarity to the pixel cells of odd-numbered pixel-cell groups, and supply the data signal of second polarity to the pixel cells of even-numbered pixel-cell groups, wherein the first polarity is opposite to the second polarity; and a shift register that is operable to drive the gate lines such that scan pulses provided with the different amplitudes and pulse widths are supplied to the neighboring pixel cells included in the different pixel-cell groups;

a timing controller that is operable to output 'n' clock pulses provided with the phase difference;

a level shifter that is operable to modulate the amplitude of 'n' clock pulses outputted from the timing controller at a constant ratio, and supply the 'n' clock pulses having the modulated amplitude to the shift register; and 'n' transmission lines that are provided with the different resistance values and capacitances, and supplies the 'n' clock pulses outputted from the timing controller to the level shifter.

27. The display device of claim 26, wherein each of 'm' transmission lines is connected between the timing controller and the level shifter through a first resistor and a first capacitor, and each of 'n−m' transmission lines is connected between the timing controller and the level shifter through a second resistor and a second capacitor.

28. The display device of claim 27, wherein the resistance value of first resistor is smaller than the resistance value of second resistor, and the capacitance of first capacitor is smaller than the capacitance of second capacitor.

29. The display device of claim 27, wherein the first and second resistors are variable resistors.

30. The display device of claim 26, wherein each of 'm' transmission lines is connected between the timing controller and the level shifter, and each of 'n−m' transmission lines is connected between the timing controller and the level shifter through a resistor and a capacitor.

31. The display device of claim 30, wherein the resistor is a variable resistor.

32. The display device of claim 26, wherein the width of each of 'm' transmission lines is larger than the width of each of 'n−m' transmission lines.

33. The display device of claim 26, wherein the 'm' transmission lines are zigzag shaped.

34. The display device of claim 26, wherein the data driver is operable to supply data signals to the pixel cells, wherein the pixel cells connected with the second data line are divided into a plurality of pixel-cell groups, each group provided with at least two pixel cells, and the data driver supplies the data signal of second polarity to the odd-numbered pixel-cell groups through the second data line, and supplies the data signal of first polarity to the even-numbered pixel-cell groups.

35. A display device comprising:

a display area that includes a plurality of pixel cells in respective pixel regions defined by a plurality of gate and data lines crossing each other;

a data driver that is operable to supply data signals to the pixel cells, wherein the pixel cells connected with the first data line are divided into a plurality of pixel-cell groups, each group provided with at least two pixel cells, wherein the data driver is operable to supply the data signal of first polarity to the pixel cells of odd-numbered pixel-cell groups, and supply the data signal of second polarity to the pixel cells of even-numbered pixel-cell groups, wherein the first polarity is opposite to the second polarity; and a shift register that is operable to drive the gate lines such that scan pulses provided with the different amplitudes and pulse widths are supplied to the neighboring pixel cells included in the different pixel-cell groups;

a timing controller that is operable to output 'n' clock pulses provided with the phase difference;

a level shifter that is operable to modulate the amplitude of 'n' clock pulses outputted from the timing controller at a constant ratio, and supply the modulated 'n' clock pulses through 'n' output lines; and a shift register that is supplied with the clock pulses through 'n' clock transmission lines respectively connected with one end of the 'n' output lines, wherein the 'n' output lines have the different resistance values and capacitances from one another.

36. The display device of claim 35, wherein each of the 'm' output lines is connected between the level shifter and each of the 'm' clock transmission lines through a first resistor and a first capacitor, and each of the 'n−m' output lines is connected between the level shifter and each of the 'n−m' clock transmission lines through a second resistor and a second capacitor.

37. The display device of claim 36, wherein the resistance value of first resistor is smaller than the resistance value of second resistor, and the capacitance of first capacitor is smaller than the capacitance of second capacitor.

38. The display device of claim 36, wherein the first and second resistors are variable resistors.

39. The display device of claim 35, wherein each of the 'm' output lines is connected between the level shifter and each of the 'm' clock transmission lines, and each of the 'n−m' output lines is connected between the level shifter and each of the 'n−m' clock transmission lines through the resistor and capacitor.

40. The display device of claim 39, wherein the resistor is a variable resistor.

41. The display device of claim 35, wherein the width of each of 'm' output lines (where 'm' is an integer smaller than 'n') is larger than the width of each of 'n−m' output lines.

42. A display device comprising:

a display area that includes a plurality of pixel cells in respective pixel regions defined by a plurality of gate and data lines crossing each other;

a data driver that is operable to supply data signals to the pixel cells, wherein the pixel cells connected with the first data line are divided into a plurality of pixel-cell groups, each group provided with at least two pixel cells, wherein the data driver is operable to supply the data signal of first polarity to the pixel cells of odd-numbered pixel-cell groups, and supply the data signal of second polarity to the pixel cells of even-numbered pixel-cell groups, wherein the first polarity is opposite to the second polarity; and a shift register that is operable to drive the gate lines such that scan pulses provided with the different amplitudes and pulse widths are supplied to the neighboring pixel cells included in the different pixel-cell groups;

a timing controller that is operable to output 'n' clock pulses provided with the phase difference;

a level shifter that is operable to modulate the amplitude of 'n' clock pulses outputted from the timing controller at a constant ratio, and supply the modulated 'n' clock pulses to the shift register; and 'n' clock transmission lines which are provided with the different resistance values and capacitances, and supply the clock pulses outputted from the level shifter to the shift register.

43. The display device of claim 42, wherein each of 'm' clock transmission lines is connected between the level shifter and the shift register through a first resistor and a first capacitor, and each of 'n−m' clock transmission lines is connected between the level shifter and the shift register through a second resistor and a second capacitor.

44. The display device of claim 43, wherein the resistance value of first resistor is smaller than the resistance value of second resistor.

45. The display device of claim 43, wherein the first and second resistors are variable resistors.

46. The display device of claim 42, wherein each of 'm' clock transmission lines is connected between the level shifter and the shift register, and each of 'n−m' clock transmission lines is connected between the level shifter and the shift register through a resistor and a capacitor.

47. The display device of claim 46, wherein the resistor is a variable resistor.

48. The display device of claim 42, wherein the width of each of 'm' clock transmission lines is larger than the width of each of 'n−m' clock transmission lines.

49. The display device of claim 42, wherein the 'm' transmission lines are zigzag shaped.

* * * * *